US010805741B2

(12) United States Patent
Anderson

(10) Patent No.: US 10,805,741 B2
(45) **Date of Patent: *Oct. 13, 2020**

(54) AUDIO SYSTEMS, DEVICES, AND METHODS

(71) Applicant: Dean Robert Gary Anderson, Orem, UT (US)

(72) Inventor: Dean Robert Gary Anderson, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/200,588

(22) Filed: Nov. 26, 2018

(65) Prior Publication Data

US 2019/0191253 A1 Jun. 20, 2019

Related U.S. Application Data

(63) Continuation of application No. 15/396,662, filed on Jan. 1, 2017, now Pat. No. 10,142,742.

(60) Provisional application No. 62/274,240, filed on Jan. 1, 2016.

(51) Int. Cl.
*H04R 25/00* (2006.01)

(52) U.S. Cl.
CPC ..... *H04R 25/453* (2013.01); *H04R 25/30* (2013.01); *H04R 25/353* (2013.01); *H04R 25/43* (2013.01); *H04R 25/502* (2013.01); *H04R 25/505* (2013.01); *H04R 25/70* (2013.01); *H04R 2225/43* (2013.01); *H04R 2430/01* (2013.01)

(58) Field of Classification Search
CPC . H04R 25/353; H04R 2225/43; G10L 21/038; G10L 21/0388
See application file for complete search history.

(56) References Cited

U.S. PATENT DOCUMENTS 3,385,937 A * 5/1968 Lafon ..... H04R 25/353 381/316
3,781,491 A 12/1973 Biondi et al.
4,051,331 A * 9/1977 Strong ..... G10L 19/04 381/320
4,403,118 A * 9/1983 Zollner ..... H04R 25/353 381/101
5,197,332 A 3/1993 Shennib
5,325,436 A 6/1994 Soli et al.
(Continued)

FOREIGN PATENT DOCUMENTS

EP 1933590 A1 6/2008
GB 2394632 A 4/2004
(Continued)

OTHER PUBLICATIONS

Sakamoto et al.; "Frequency compression hearing aid for severe-to-profound hearing impairments"; Oct 2000. Auris Nasus Larynx; vol. 27. Issue 4; pp. 327-334.
(Continued)

*Primary Examiner* — Fan S Tsang
*Assistant Examiner* — Ryan Robinson
(74) *Attorney, Agent, or Firm* — Daniel Anderson

(57) ABSTRACT

In one embodiment, an audio system can replace a portion of an audio signal within a first range of frequencies, with an amplitude modulated noise signal comprising frequencies within the first range of frequencies and having a volume envelope corresponding to a volume envelope of the audio signal within a second range of frequencies.

8 Claims, 28 Drawing Sheets

(56) References Cited

U.S. PATENT DOCUMENTS

| | | | | |
|---|---|---|---|---|
| 5,396,560 | A | 3/1995 | Arcos et al. | |
| 5,717,767 | A | 2/1998 | Inanaga et al. | |
| 5,825,894 | A | 10/1998 | Shennib | |
| 5,868,682 | A | 2/1999 | Combs et al. | |
| 5,870,481 | A | 2/1999 | Dymond et al. | |
| 5,878,146 | A | 3/1999 | Andersen | |
| 5,923,764 | A | 7/1999 | Shennib | |
| 6,167,138 | A | 12/2000 | Shennib | |
| 6,201,875 | B1 | 3/2001 | Davis et al. | |
| 6,236,731 | B1 | 5/2001 | Brennan et al. | |
| 6,389,142 | B1 | 5/2002 | Hagen et al. | |
| 6,567,524 | B1 | 5/2003 | Svean et al. | |
| 6,574,342 | B1 | 6/2003 | Davis et al. | |
| 6,577,740 | B1 | 6/2003 | Bordewijk | |
| 6,674,862 | B1 | 1/2004 | Magilen | |
| 6,731,769 | B1 | 5/2004 | Lenhardt | |
| 6,885,752 | B1 | 4/2005 | Chabries et al. | |
| 6,912,289 | B2 | 6/2005 | Vonlanthen et al. | |
| 7,058,188 | B1 | 6/2006 | Allred | |
| 7,206,423 | B1 | 4/2007 | Feng et al. | |
| 7,418,379 | B2 | 8/2008 | Vierthaler | |
| 7,502,483 | B2 * | 3/2009 | Rikimaru | H04R 25/505 381/320 |
| 7,903,833 | B2 | 3/2011 | Goldberg et al. | |
| 8,094,834 | B1 | 1/2012 | Brungart | |
| 8,325,956 | B2 * | 12/2012 | Neher | H04R 25/353 381/23.1 |
| 8,553,897 | B2 | 10/2013 | Anderson | |
| 8,879,745 | B2 | 11/2014 | Anderson | |
| 8,942,397 | B2 * | 1/2015 | Anderson | H04R 25/50 381/316 |
| 9,101,299 | B2 | 8/2015 | Anderson | |
| 9,491,559 | B2 | 11/2016 | Anderson | |
| 2003/0142746 | A1 | 7/2003 | Tanka et al. | |
| 2004/0006283 | A1 | 1/2004 | Harrison et al. | |
| 2004/0076301 | A1 | 4/2004 | Algazi et al. | |
| 2006/0008102 | A1 | 1/2006 | Westergaard | |
| 2006/0182294 | A1 | 8/2006 | Grasbon et al. | |
| 2006/0204013 | A1 | 9/2006 | Hannibal et al. | |
| 2006/0210090 | A1 | 9/2006 | Shennib | |
| 2007/0127753 | A1 | 6/2007 | Feng | |
| 2007/0223720 | A1 | 9/2007 | Goldberg | |
| 2009/0116657 | A1 | 5/2009 | Edwards et al. | |
| 2009/0208024 | A1 | 8/2009 | Farver et al. | |
| 2010/0316240 | A1 | 12/2010 | Semcken et al. | |
| 2011/0150256 | A1 | 6/2011 | Baechler et al. | |
| 2011/0170711 | A1 | 7/2011 | Rettelbach | |
| 2014/0288938 | A1 * | 9/2014 | Kong | H04R 1/08 704/268 |

FOREIGN PATENT DOCUMENTS

| | | | |
|---|---|---|---|
| WO | 2002009473 | A2 | 1/2002 |
| WO | 2008141672 | A1 | 11/2008 |
| WO | 2016096043 | A1 | 6/2016 |

OTHER PUBLICATIONS

Alger, Alexandra. "A Chip in the Ear." FORBES. Nov. 2, 1998.

Gelfand, Stanley A. Essentials of Audiology, Third Edition, Mar. 2009, Thieme, pp. 250-253.

Edgar Vilchur, "Signal Processing to Improve Speech Intelligibility in Perceptive Deafness", The Journal of the Acoustical Society of America, vol. 53, No. 6, 1973, pp. 1646-1657 (Abstract) (https://asa.scitation.org/doi/abs/10.1121/1.1913514).

Ghent, Robert M., Jr. et al. "Interactive Binaurally Balanced Fittings for Improved Audibility, Reduced Costs, and Fewer Return Visits" The Hearing Review, Nov. 3, 2011.

Kraus, Eric M., MD, et al., "Envoy Esteem Totally Implantable Hearing System : Phase 2 Trial, 1-Year Hearing Results," Otolaryngology—Head and Neck Surgery, American Academy of Otolaryngology, Mar. 31, 2011.

* cited by examiner

AUDIO SYSTEMS, DEVICES, AND METHODS

CROSS-REFERENCE TO RELATED APPLICATIONS

The present application is a continuation application of co-pending U.S. patent application Ser. No. 15/396,662, filed on Jan. 1, 2017, which claims the benefit of priority from: U.S. Provisional Application No. 62/274,240 filed on Jan. 1, 2016, all of which are hereby fully incorporated by reference.

BACKGROUND

The present invention relates, in general, to electronics and, more particularly, to audio systems, devices, and methods.

Speech understanding or speech intelligibility is critical for effective communication and thus is of particular concern to the designer and user of almost any audio system. One example audio system for which speech intelligibility is of critical importance is the hearing aid. Vast amounts of time and money have been invested into improving the speech intelligibility of hearing aids over the last century. Improvements such as electric hearing aids were introduced more than 100 years ago. Digital signal processing was added to hearing aids more than 25 years ago.

Despite these improvements and their long history, however, modern hearing aids continue to suffer from a myriad of problems. For example, hearing aids are expensive. Typically, a pair of hearing aids can cost between $1,500 and $6,000. In some instances, hearing aids can cause additional hearing loss to the user's residual hearing. By their nature, conventional hearing aids operate by amplifying sound. However, over-amplification can result in additional hearing damage to the user's remaining hearing. Over-amplification is prevalent due to imprecise measurements of patient hearing thresholds, problematic fitting protocols, large speaker and microphone tolerances, and user demand for additional amplification as a solution for ineffective hearing aids.

Short battery life is another problem area for hearing aids. Hearing aid users can become frustrated with the nuisance of frequently changing or charging batteries. Feedback caused by the recursive pick up and amplification of the hearing aid's own output signal can result in disruptive and uncomfortable squealing noises. Furthermore, many hearing aid users are self-conscious about the aesthetics of hearing aids and are uncomfortable wearing visible hearing aids in public. Earwax accumulation, frequent maintenance, skin irritation, occlusion effect, the list of problems for users of hearing aids goes on and on. And yet, despite all of these problems, one of the most troubling and frequently complained about problems of hearing aids is that they are ineffective, particularly in noisy environments.

Accordingly, it is desirable to have an audio system, device, and method for solving at least the above mentioned problems, and in particular, it is desirable to have a hearing aid which is effective in improving speech understanding and speech intelligibility, especially in noisy environments.

Figure 1:
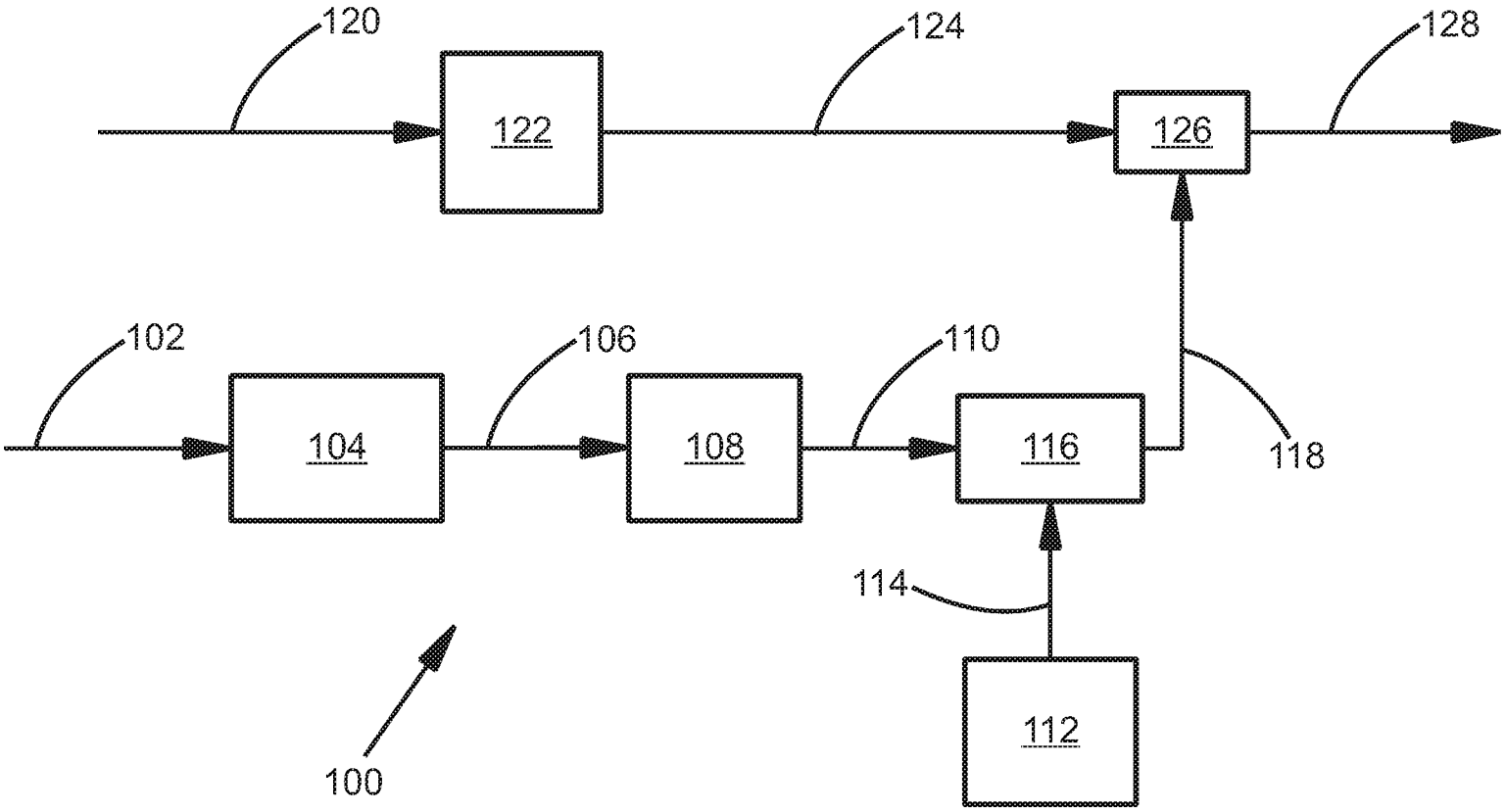
FIG. 1 illustrates a schematic diagram of an audio system.

The drawings and detailed description are provided in order to enable a person skilled in the applicable arts to make and use the invention. The systems, structures, circuits, devices, elements, schematics, signals, signal processing schemes, flow charts, diagrams, algorithms, frequency values and ranges, amplitude values and ranges, methods, source code, examples, etc. and the written descriptions are illustrative and not intended to be limiting of the disclosure. Descriptions and details of well-known steps and elements are omitted for simplicity of the description.

For simplicity and clarity of the illustration, elements in the figures are not necessarily drawn to scale, and the same reference numbers in different figures denote the same elements.

As used herein, the term and/or includes any and all combinations of one or more of the associated listed items. In addition, the terminology used herein is for the purpose of describing particular embodiments only and is not intended to be limiting of the disclosure. As used herein, the singular forms are intended to include the plural forms as well, unless the context clearly indicates otherwise. It will be further understood that the terms comprise, comprises, comprising, include, includes, and/or including, when used in this specification and claims, are intended to specify a non-exclusive inclusion of stated features, numbers, steps, acts, operations, values, elements, and/or components, but do not preclude the presence or addition of one or more other features, numbers, steps, acts, operations, values, elements, components, and/or groups thereof. It will be understood that, although the terms first, second, etc. may be used herein to describe various signals, portions of signals, ranges, members, and/or elements, these signals, portions of signals, ranges, members, and/or elements should not be limited by these terms. These terms are only used to distinguish one signal, portion of a signal, range, member, and/or element from another. Thus, for example, a first signal, a first portion of a signal, a first range, a first member and/or a first element discussed below could be termed a second signal, a second portion of a signal, a second range, a second member and/or a second element without departing from the teachings of the present disclosure. It will be appreciated by those skilled in the art that words, during, while, concurrently, and when as used herein related to audio systems, devices, methods, signal processing and so forth, are not limited to a meaning that an action, step, function, or process must take place instantly upon an initiating action, step, process, or function, but can be understood to include some small but reasonable delay, such as propagation delay, between the reaction that is initiated by the initial action, step, process, or function. Additionally, the terms during, while, concurrently, and when are not limited to a meaning that an action, step, function, or process only occur during the duration of another action, step, function or process, but can be understood to mean a certain action, step, function, or process occurs at least within some portion of a duration of another action, step, function, or process or at least within some portion of a duration of an initiating action, step, function, or process, or within a small but reasonable delay after an initiating action, step, function, or process. Furthermore, as used herein, the term range, may be used to describe a set of frequencies having an approximate upper and approximate lower bound, however, the term range may also indicate a set of frequencies having an approximate lower bound and no defined upper bound, or an upper bound which is defined by some other characteristic of the system. The term range may also indicate a set of frequencies having an approximate upper bound and no defined lower bound, or a lower bound which is defined by some other characteristic of the system. Reference to "one embodiment" or "an embodiment" means that a particular feature, structure or characteristic described in connection with the embodiment is included in at least one embodiment of the present disclosure. Thus, appearances of the phrases "in one embodiment" or "in an embodiment" in various places throughout this specification are not necessarily all referring to the same embodiment, but in some cases it may. The use of word about, approximately or substantially means a value of an element is expected to be close to a stated value or position. However, as is well known in the art there are always minor variances preventing values or positions from being exactly stated. It is further understood that the embodiments illustrated and described hereinafter suitably may have embodiments and/or may be practiced in the absence of any element that is not specifically disclosed herein. Furthermore, it is understood that in some cases the embodiments illustrated and described hereinafter suitably may have embodiments and/or may be practiced with one or more of the illustrated or described elements, blocks, or signal processing steps omitted.

Those skilled in the art will understand that as used herein, the term noise can refer to many different types of noise. For example, and without limiting the disclosure, noise may mean: a sound signal with a single fixed frequency and amplitude, a warbled tone, a chirping sound, a hiss, a rumble, a crackle, a hum, a popping sound, multiple tones, a signal having a randomly changing frequency and a randomly changing amplitude over time, incoherent noise, coherent noise, a combination of tones having random frequencies and random amplitudes, a combination of tones having random frequencies and fixed amplitudes, a random sound signal, uniformly distributed noise from a pseudo-random noise generator, "white noise," "pink noise," "Brownian noise" (i.e., "red noise"), and/or "Grey noise", etc. Furthermore, "noise" may also include a noise substantially within a range of frequencies wherein the noise comprises a signal having a substantially constant amplitude and having a randomly changing period corresponding to frequencies within a range of frequencies as described hereinafter. Furthermore, the randomly changing period can change as frequently as each cycle.

Those skilled in the art will understand that as used herein, the terms fix or fixed, when used in conjunction with parameters, constants, elements, or values, can mean that for a period of time, no matter how short, a parameter, constant, element, or value can be set at a particular value. The use of the terms fix or fixed when used in conjunction with parameters, constants, elements, or values allows for the possibilities that parameters, constants, elements, or values can be reset, adjusted, changed, or variable over time.

Those skilled in the art will understand that as used herein, the terms weight, weighting, or weighted can refer to making a value proportional to another value or can refer to adjusting a value by multiplication with a fixed constant such as a fixed constant less than 1.0, a fixed constant greater than 1.0, or a fixed constant equal to 1.0. Weight, weighting, or weighted may refer to amplifying, attenuating, or holding constant (e.g. doing nothing). Weight, weighting, or weighted can also refer to multiplying or modulating one signal by a second signal.

Those skilled in the art will understand that as used herein, the terms replace, replaced, replacing, or replacement, when used in conjunction with sound signals or frequencies of sound signals, is not limited just to the elimination of a sound signal or frequencies of a sound signal and the provision of a substitute, but the terms may also refer to reducing or attenuating a sound signal or frequencies of a sound signal and the provision of a substitute. The terms may also refer to overwriting a sound signal or portion of a sound signal with a substitute. Furthermore, the terms may also refer to superimposing one signal on top of another signal or on top of a portion of a sound signal.

Those skilled in the art will understand that as used herein, the terms audio device or audio system can refer to a stand-alone system or a subsystem of a larger system. A non-limiting list of example audio systems can include: hearing aids, personal sound amplification products, televisions, radios, cell phones, telephones, computers, laptops, tablets, vehicle infotainment systems, audio processing equipment and devices, personal media players, portable media players, audio transmission systems, transmitters, receivers, public address systems, media delivery systems, internet media players, smart devices, hearables, recording devices, subsystems within any of the above devices or systems, or any other device or system which processes audio signals.

As herein described or illustrated, components, elements, or blocks that are connected, coupled, or in communication may be electronically coupled so as to be capable of sending and/or receiving electronic signals between electronically coupled components, elements, or blocks, or linked so as to be capable of sending and/or receiving digital or analog signals, or information, between linked components, elements, or blocks. Coupling or connecting components, elements, or blocks as described or illustrated herein does not foreclose the possibility of including other intervening components, elements or blocks between the coupled or connected components, elements, or blocks. Coupling or connecting may be accomplished by hard wiring components elements or blocks, wireless communication between components, elements, or blocks, on-chip or on-board communications and the like.

Many electronic and mechanical alternatives are also possible to implement individual objectives of various components, elements, or blocks described or illustrated herein. For example, the function of a filtered volume reducer could be accomplished via a completely or partially occluding ear mold, hearing aid dome, propeller, tip, receiver, etc., or, the function of a mixer could be accomplished via air conduction mixing of two acoustic signals. Furthermore, software or firmware operating on a digital device may be used to implement individual objectives of various components, elements, or blocks described or illustrated herein.

Multiple instances of embodiments described or illustrated herein may be used within a single audio device or system. As an example, multiple instances of embodiments described or illustrated herein may enable the processing of subdivisions of the various ranges of frequencies described herein. As another example, multiple instances of embodiments described or illustrated herein may enable a stereo audio device comprising a first instance of an embodiment for a right band and a second instance of an embodiment for a left band.

The inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software, hardware or a combination of both. It should be noted that there are many different and alternative configurations, devices and technologies to which the disclosed inventions may be applied. Thus, the full scope of the inventions is not limited to the examples that are described below.

Various aspects of the present invention may be described in terms of functional block components and various signal processing steps. Such functional blocks may be realized by any number of hardware and/or software components configured to perform the specified functions and achieve the various results. In addition, various aspects of the present invention may be practiced in conjunction with any number of audio devices, and the systems and methods described are merely exemplary applications for the invention. Further, exemplary embodiments of the present invention may employ any number of conventional techniques for audio filtering, amplification, noise generation, modulation, mixing and the like.

It is noted that signal processing can be done in analog or digital form and various systems have a mixture of both analog and digital processes. The invention described herein can be implemented by analog or digital processes or a mixture of both analog and digital processes. Thus it is not a limitation of the invention that any particular process be implemented as either analog or digital. Those skilled in the art will readily see how to implement the invention using both analog and digital processes to achieve the results and benefits of the invention.

Various representative implementations of the present invention may be applied to any system for audio devices. For example, certain representative implementations may include: hearing aid devices and personal sound amplification products.

DETAILED DESCRIPTION OF THE DRAWINGS

FIG. 1 illustrates a schematic diagram of an audio system 100. Audio system 100 is generally configured to receive an input signal which may contain speech information, process the signal, and output a signal having improved speech intelligibility. Audio system 100 can be a stand-alone system or can be a subsystem of a larger system. Audio system 100 includes a filtered volume determiner 104, a fixed volume adder 108, a filtered noise generator 112, a signal modulator 116, a filtered volume reducer 122, and a mixer 126. Filtered volume determiner 104 is configured to receive a first signal 102. First signal 102 may be an audio signal. First signal 102 may be either an analog signal or a digital signal. Those skilled in the art will appreciate that either analog signal processing or digital signal processing can be used without departing from the teachings of the specification. Typically, analog signals can be converted to digital signals through the use of an analog-to-digital converter ("ADC"). Furthermore, digital signals can be converted to analog signals through the use of a digital-to-analog converter ("DAC"). According to the present embodiment, first signal 102 is an audio signal containing speech information. Filtered volume determiner 104 can be configured to filter first signal 102. According to an embodiment, filtered volume determiner 104 can comprise a band-pass filter which allows a first range of selected frequencies from first signal 102 to pass. Alternatively, filtered volume determiner 104 can comprise a high-pass or low-pass filter which allows frequencies above or below a certain frequency from first signal 102 to pass. According to an embodiment, the selected band of frequencies or range of passed frequencies can correspond to a range of frequencies which typically contain unvoiced phones. Speech information is generally comprised of phones or distinct speech sounds. For example, a single syllable word such as "talk" can be considered to contain three (or even more) phones. Generally, phones can be divided into two classes: voiced phones and unvoiced phones. Typically, voiced phones derive the majority of their sound from the vocal cords. The vowel sounds are good examples of voiced phones. Unvoiced phones, on the other hand, mostly derive their sound from rushing air. The sounds of letters like 's', 't' and 'k' are good examples of unvoiced phones. Some sounds have components of both voiced and unvoiced sounds. The sound of the letter 'z' is a good example of a sound having both voiced and unvoiced components. Often, speech alternates between emphasis on voiced and unvoiced phones. During a typical conversation, an English speaker may speak at a rate of about 110 to 150 words per minute. Assuming that the average word contains approximately 5 phones, then a typical English conversation may contain about 9.2 to 12.5 phones per second.

In one embodiment, the range of frequencies selected by filtered volume determiner 104 may be between about 1400 Hz to about 4500 Hz. In another embodiment, the range of frequencies may be between about 2000 Hz to about 2520 Hz (⅓ of an octave). In another embodiment, the range of frequencies may be narrower. In another embodiment, the selected range of frequencies can be wider. In another embodiment the range of selected frequencies may be selected to correspond to a range of frequencies for which a listener of audio system 100 has hearing loss. In another embodiment the range of selected frequencies may be selected to correspond to an average range of frequencies for which a population of people has hearing loss. Methods and systems for determining frequency based hearing loss are known in the audiological arts. In yet another embodiment, the range of selected frequencies may be selected by the user of audio system 100 and can be adjusted dynamically via programming of audio system 100 or via a user control. It is also noted that audio system 100 may comprise multiple filtered volume determiners, each running in parallel and wherein each is designed to filter a different band of selected frequencies. For example, each of the multiple filtered volume determiners may be selected to pass a range of ⅓ octave between about 1260 Hz and about 5040 Hz. For example, such ranges could be from about: 1260 to 1587 Hz; 1587 to 2000 Hz; 2000 to 2520 Hz; 2520 to 3175 Hz; 3175 to 4000 Hz; and, 4000 to 5040 Hz. Further subdivisions could also be used. According to another embodiment, filtered volume determiner 104 acts as a high-pass filter and selects to pass all frequencies above a certain frequency. For example, filtered volume determiner 104 can pass all frequencies above about 1200 Hz, or 1250 Hz, or 1300 Hz, or 1350 Hz, etc.

According to an embodiment, after filtering first signal 102, filtered volume determiner 104 can determine the volume envelope of the filtered first signal. Thus, the filtered volume determiner 104 can be configured to generate a second signal 106, which corresponds to a volume envelope for a first range of selected frequencies of the first signal 102. According to an embodiment, filtered volume determiner 104 can measure the time varying volume envelope of sounds where an individual has restricted sound perception. According to an embodiment, filtered volume determiner 104 may also be used to reduce extraneous environmental noise, microphone noise, analog to digital conversion noise, impact noise, etc., for example, by subtracting the minimum value observed in the time varying volume envelope during the preceding 0.5 second from the current value. This technique relies on the idea that a phone in a frequency band will vary in volume faster than 0.5 seconds and consequently the minimum amplitude value (in the preceding 0.5 seconds) can be attributed to steady state conditions such as wind noise, mechanical noise, crowd noise, etc. Another example is to use a moving average where the time varying volume is averaged during the preceding 0.01 seconds. This technique relies on the idea that variations in the amplitude value of a phone in a frequency band may not vary in volume faster than 0.01 seconds. Thus variations in the moving average faster than 0.01 seconds can be attributed to microphone noise, analog to digital conversion noise, etc. Still another example involves comparing the moving average for the current 0.01 seconds to the moving average for the previous 0.01 seconds before the current 0.01 seconds. If the value for the current moving average is greater than the previous moving average by a large fixed value, for example 12 dB, then the current moving average can be set to the previous moving average plus the large fixed value. Using this technique, impact noise such as dish clatter, solid objects hitting, etc. can be reduced. Other noise reduction techniques can also be implemented.

Fixed volume adder 108 can be coupled to filtered volume determiner 104. Fixed volume adder 108 can be configured to receive from filtered volume determiner 104 second signal 106. Fixed volume adder 108 can be configured to generate a third signal 110 corresponding to the sum of second signal 106, which may or may not be weighted, and a fixed value. According to one embodiment, the fixed value is chosen to be approximately equal to an individual's threshold of hearing as measured at a particular frequency within a second range of frequencies. According to another embodiment, the fixed value is chosen to be approximately equal to the interpolated value of the individual's threshold of hearing at a particular frequency between measured values of the individual's threshold of hearing within a second range of frequencies. According to one embodiment, the second range of selected frequencies can correspond to a range of frequencies where the user of audio system 100 has available hearing or, for example, a lower threshold of hearing than another range of frequencies. Those skilled in the art will recognize various methods and systems for determining hearing loss. The second range of frequencies can be above, below, or at the same range as the first range of frequencies. Furthermore, the second range of frequencies can overlap. Furthermore, the second range of frequencies can be wider, narrower, or the same width as the first range of frequencies. It is noted that due to the complex and unique hearing loss and hearing needs of each individual, the appropriate frequency range of the first and second frequency ranges can vary dramatically from individual to individual. Those skilled in the art will recognize choices for the first and second range of frequencies based on the hearing of the user or the average hearing characteristics of a group of users that will maximize speech intelligibility. Furthermore, the complexity of the audio system may also play a role in choosing frequency ranges. For example, an audio system may have one or more parallel processing bands. With the ability to process additional bands in parallel, the selected ranges of frequencies can become narrower.

According to an embodiment, fixed volume adder 108 can add a fixed value to second signal 106. The fixed value can function to raise, lift or translate second signal 106. The fixed value can be approximately equal to an individual's threshold of hearing for a range of selected frequencies. The range of selected frequencies can correspond to a range of frequencies which are reduced by filtered volume reducer 122. According to an embodiment, the fixed value added may be determined by independent measurements of an individual's threshold of hearing for a range of selected frequencies. According to another embodiment, the fixed value added may also be estimated by interpolation of other independent measurements. According to another embodiment, the fixed value may be selected according to characteristic values in a population of individuals with hearing loss. According to another embodiment, the fixed value may be selected as being the most comfortable for an individual user. According to another embodiment, the fixed value may be selected as being approximately equal to an individual's threshold of hearing for a range of frequencies where the individual has reduced hearing loss. According to another embodiment, the fixed value may be zero or near zero, or alternatively, fixed value adder 108 may be completely omitted from audio system 100 or selectively disabled during operation of audio system 100. Many other techniques may be used to choose the fixed value without departing from the present disclosure.

Filtered noise generator 112 can be configured to generate a fourth signal 114 corresponding to noise substantially within the second range of selected frequencies. According to an embodiment, filtered noise generator 112 may generate a noise signal, and thereafter filter the noise signal by passing frequencies within about the second range of selected frequencies. Subsequently, filtered noise generator 112 may amplify or attenuate the filtered noise signal. In another embodiment, filtered noise generator 112 can be configured to generate a noise signal which is already within the second range of frequencies. It is noted then that the filtered noise generator 112 does not necessarily perform a filtering function on all types of generated noise signals, as some noise signals can be generated to be within a particular range of frequencies and thus would not require subsequent filtering. Effectively, such noise signals can be "pre-filtered".

Signal modulator 116 can be coupled to fixed volume adder 108 and to filtered noise generator 112. Signal modulator 116 can be configured to receive from fixed volume adder 108 the third signal 110, and signal modulator 116 can be configured to receive from filtered noise generator 112 the fourth signal 114. Signal modulator 116 can be configured to generate a fifth signal 118 substantially similar to a product of third signal 110 and fourth signal 114.

By multiplying the signal from fixed volume adder 108 and the signal from filtered noise generator 112, signal modulator 116 can enable various beneficial results. First, the faintest parts of speech in the band are now loud enough to exceed an individual's hearing threshold for the band. The fixed added noise component can be below the threshold of hearing for an individual and may not, in some instances, be heard or perceived by the individual. The time varying, amplitude modulated noise component can be greater than the individual's hearing threshold for the band and thus this time varying, amplitude modulated noise component may be distinctly heard by the individual. Second, given that the dynamic range of unvoiced phones is approximately 20 dB for many speakers, the time varying, amplitude modulated noise component may not require compression and is simply "lifted" above the individual's hearing threshold for the band. As an example, for a band where the individual's threshold may be less than about 65 dBHL, the full dynamic range of the time varying, amplitude modulated noise component can be preserved while also limiting the maximum sound level to about 85 dBHL. Notably, this enables the perceived signal-to-noise ratio to be left unchanged and, if desired, techniques of conventional Wide Dynamic Range Compression ("WDRC") can be generally avoided in higher frequency bands, such as frequencies above about 1000 Hz. Furthermore, a greater than 1.0 weighting of the time varying, amplitude modulated noise component can also be used to expand the dynamic range of the time varying, amplitude modulated noise component and thereby enabling an increased signal-to-noise ratio. Third, critical speech information can be redistributed to frequencies where an individual has remaining hearing resulting in an increase in speech intelligibility.

Filtered volume reducer 122 can be configured to receive a sixth signal 120. Sixth signal 120 can be first signal 102 or substantially similar to first signal 102. For example, first signal 102 can be split into two pathways creating first signal 102 and sixth signal 120. Those skilled in the art will recognize various analog and digital methods for signal splitting. Filtered volume reducer 122 can be configured to generate a seventh signal 124 corresponding to a filtered, weighted sixth signal 120. Filtered volume reducer 122 is configured to filter sixth signal 120. According to an embodiment, filtered volume reducer 122 can act as a notch-filter, wherein a third range of frequencies is selectively filtered out or attenuated from sixth signal 120. According to one embodiment, the third range of frequencies can be selected to correspond substantially with the second range of selected frequencies. According to another embodiment, the third range of frequencies can overlap at least a portion of the second range of selected frequencies. According to another embodiment, filtered volume reducer 122 can act as a low-pass filter, wherein all frequencies above approximately the lowest frequency of the second range of frequencies are filtered out or attenuated. Furthermore, sixth signal 120 may be weighted before or after filtering. Seventh signal 124 can correspond to a weighted, filtered sixth signal 120 wherein the frequencies within the third range of frequencies have been reduced, attenuated or eliminated.

A mixer 126 can be coupled to signal modulator 116 and to filtered volume reducer 122. Mixer 126 can be configured to receive from signal modulator 116 fifth signal 118, and mixer 126 can be configured to receive from filtered volume reducer 122 seventh signal 124. Mixer 126 can be configured to generate an eighth signal 128 substantially similar to the sum of fifth signal 118 and seventh signal 124. Eighth signal 128 may also be weighted.

Audio system 100 thus enables the replacement, masking, or overwriting of a selected range of frequencies of an audio signal with noise. The noise can be generated to comprise frequencies within a selected range of frequencies. The noise can be amplitude modulated according to the volume envelope of a separately selected range of frequencies of the audio signal. Furthermore, a fixed value can also be added to or multiplied with the noise signal in order to boost, lift, weight, or translate the noise signal. The various selected ranges of frequencies can be selected or adjusted in order to increase the speech intelligibility of an audio signal for a user. The value of the fixed value can also be selected or adjusted in order to increase the speech intelligibility of an audio signal for a user. The various selected ranges of frequencies may overlap partially or completely or alternatively may not overlap at all.

Audio system 100 thus enables benefits of improved audibility, speech intelligibility, and word recognition characteristics of sound produced by an audio device that incorporates audio system 100.

According to one embodiment of audio system 100, consider an example wherein an individual has sensorineural hearing loss beginning at around 3500 Hz and which deteriorates increasingly with higher frequencies. According to this embodiment, filtered volume determiner 104 can be configured to generate second signal 106, which corresponds to a volume envelope for a first range of selected frequencies, for example, 3175 Hz to 5000 Hz of first signal 102. Fixed volume adder 108 can be configured to generate third signal 110 corresponding to the sum of a weighted second signal 106 and a fixed value wherein the fixed value can be made approximately equal to the individual's threshold of hearing for a second range of selected frequencies, for example, the individual's average of thresholds of hearing at 3000 Hz and at 4000 Hz. Filtered noise generator 112 can be configured to generate fourth signal 114 corresponding to audio noise substantially within the second range of selected frequencies, for example, 3175 Hz to 4000 Hz. Fourth signal 114 can be modulated by third signal 110 by signal modulator 116 which can produce fifth signal 118. Filtered volume reducer 122 can be configured to generate seventh signal 124 corresponding to a filtered, weighted sixth signal 120 wherein that portion of the weighted sixth signal substantially within a third range of selected frequencies can be reduced or eliminated, for example, frequencies above 3175 Hz could be reduced or eliminated. Seventh signal 124 and fifth signal 118 can be mixed by mixer 126 producing eighth signal 128.

According to another embodiment of audio system 100, consider an embodiment wherein an individual with congenital hearing loss who has little or no hearing response for frequencies above 600 Hz. In this embodiment, filtered volume determiner 104 can be configured to generate second signal 106, which corresponds to a volume envelope for a first range of selected frequencies, for example, 1400 Hz to 4500 Hz of first signal 102. Fixed volume adder 108 can be configured to generate third signal 110 corresponding to the sum of a weighted second signal 106 and a fixed value made approximately equal to the individual's threshold of hearing for a second range of selected frequencies, for example, the individual's average of thresholds of hearing at 400 Hz and 600 Hz. Alternatively, the fixed value could be determined by the individual according to his personal preferences. Filtered noise generator 112 can be configured to generate fourth signal 114 corresponding to audio noise substantially within the second range of selected frequencies, for example, 400 Hz to 600 Hz. Fourth signal 114 can be modulated by third signal 110 by signal modulator 116 which can produce fifth signal 118. Filtered volume reducer 122 can be configured to generate seventh signal 124 corresponding to a filtered, weighted sixth signal 120 wherein that portion of the weighted sixth signal substantially within a third range of selected frequencies can be reduced or eliminated, for example, all frequencies above 400 Hz could be reduced or eliminated. Seventh signal 124 and fifth signal 118 can be mixed by mixer 126 producing eighth signal 128.

According to various embodiments, WDRC processing or Automatic Gain Control ("AGC") processing or other processing techniques could be applied to a signal similar to first signal 102 in order to create sixth signal 120. Sixth signal 120 can then be subsequently filtered by the filtered volume reducer 122 to generate seventh signal 124.

According to various other embodiments, different frequencies, frequency ranges, fixed values, and so forth, can be chosen to fit the specific needs of an individual or a group.

Thus, according to various embodiments, audio system 100 can enable a user to preserve the fundamental frequencies of voiced speech as well as other harmonics of the fundamental frequencies of voiced speech. And furthermore, audio system 100 can enable a user to "hear" the unvoiced phones of speech as amplitude modulated noise shifted to a lower frequency range. For example, high frequency speech sounds between 1400 Hz and 4500 Hz, can be heard as amplitude modulated noise within a lower frequency range where an individual may have improved or remaining hearing. Thus, audio system 100 provides the benefit of a significant improvement in an individual's ability to hear and understand speech.

FIGS. 2-19 are provided and described herein to illustrate various embodiments of processing of an example audio signal by audio system 100.

Figure 2:
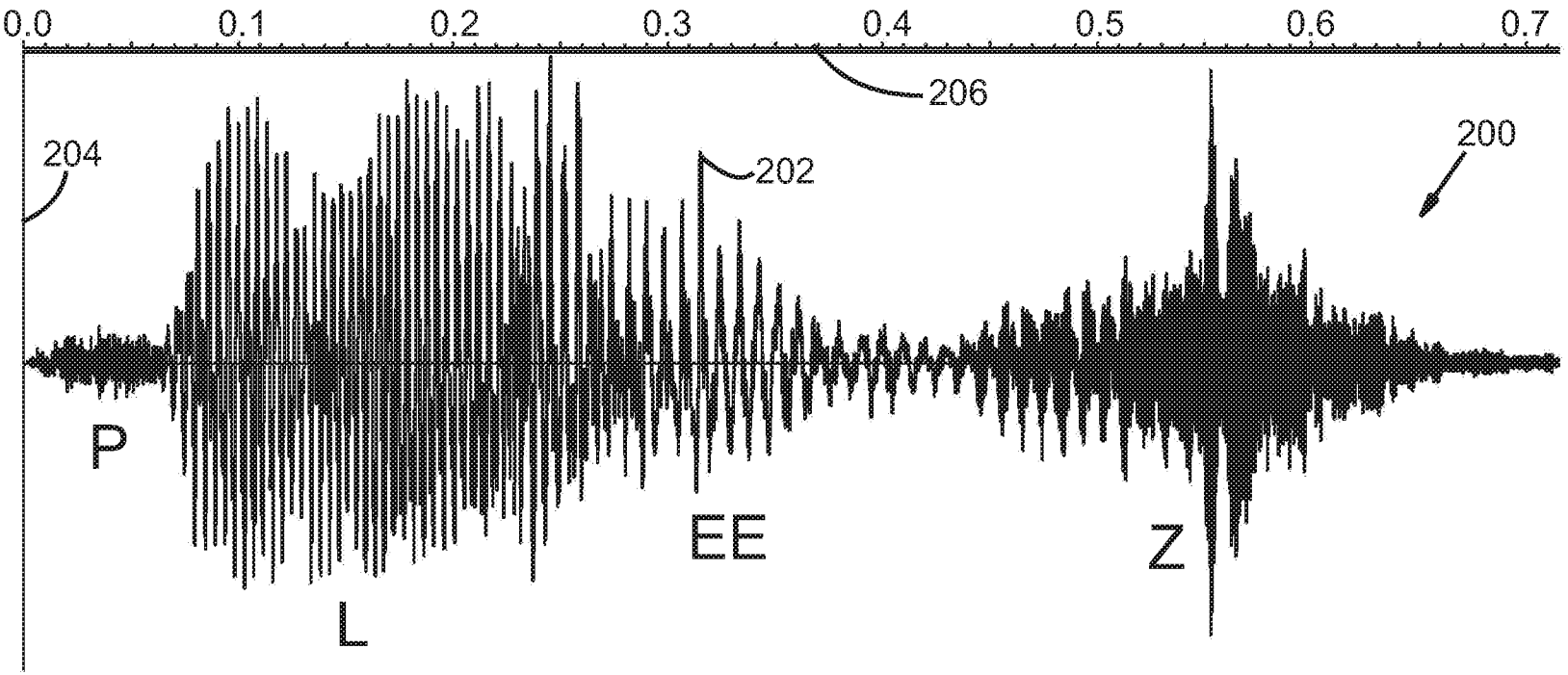
FIG. 2 illustrates an example waveform graph of an example first signal.

FIG. 2 illustrates an example waveform graph 200 of an example first signal 202. Example first signal 202 is shown with an instantaneous sound pressure 204 plotted as a function of time 206 between 0.0 seconds and 0.7 seconds. Example first signal 202 is representative of the sound, or speech waveform, of a person saying the word "please". Various phones of the word please are indicated in time with the letters 'p', 'l', 'ee', and 'z'. It is interesting to note that the unvoiced phone 'p' has many high frequency components. The lower fundamental frequencies of the voiced phones 'l' and 'ee' can also be seen. The voiced and unvoiced frequencies of the phone 'z' can also be seen.

Figure 3:
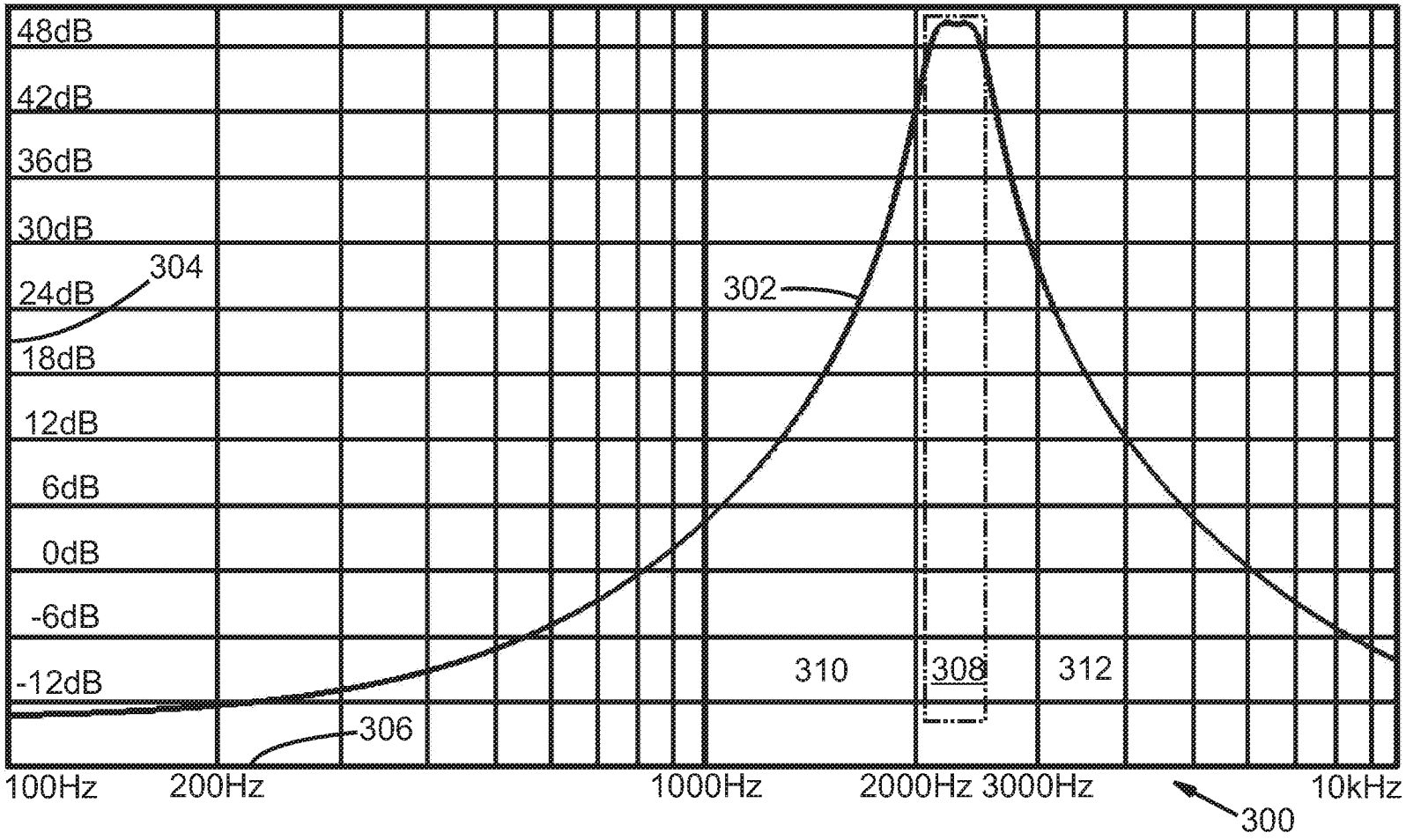
FIG. 3 illustrates a frequency response graph.

FIG. 3 illustrates a frequency response graph 300. Frequency response graph 300 indicates a first range of selected frequencies 308 (in this example: 2000 Hz to 2520 Hz) for filtered volume determiner 104 (see FIG. 1). Frequency response graph 300 indicates a frequency response 302 as a function of gain 304 and frequency 306. It is noted that negative gain is often referred to as attenuation. According to an embodiment, frequency response 302 can be approximately equivalent to a series combination of two Q-Factor biquad Equalizer Filters: the first with filter parameters: Fc=2,140 Hz, Q=8, Gain=30 dB, Scale=0.635533348260671; and the second with filter parameters: Fc=2,460 Hz, Q=8, Gain=30 dB, Scale=0.603347404934609. These filter parameters were selected so as to allow filtered volume determiner 104 to use, pass, or allow selected frequencies 308 of example first signal 202 and to effectively restrict, filter, reduce, or attenuate other frequencies 310 and 312. Those skilled in the art will recognize that there are multiplicities of filter combinations, types, orders, and filter parameters that may be used to accomplish similar objectives for first range of selected frequencies 308 which may be used for the generation of a filtered signal. For example, high pass and low pass filter types might be used including Linkwitz-Riley, Bessel, Chebychev, Cauer (elliptic), and the like. Alternately, band pass filters of sufficient width could be used. Furthermore, those skilled in the art will appreciate that the filters may include active, passive, digital, analog, mechanical, delay line, or other filter technologies. In some embodiments, first range of selected frequencies 308 may be selected to correspond to an individual's unique hearing loss. For example, first range of selected frequencies 308 may be selected to correspond to a band where a user has hearing loss. In some embodiments, first range of selected frequencies 308 may be determined by each individual's personal preference. In yet other embodiments, other strategies for the determination of first range of selected frequencies 308 have been described and will be apparent to those skilled in the art.

Figure 4:
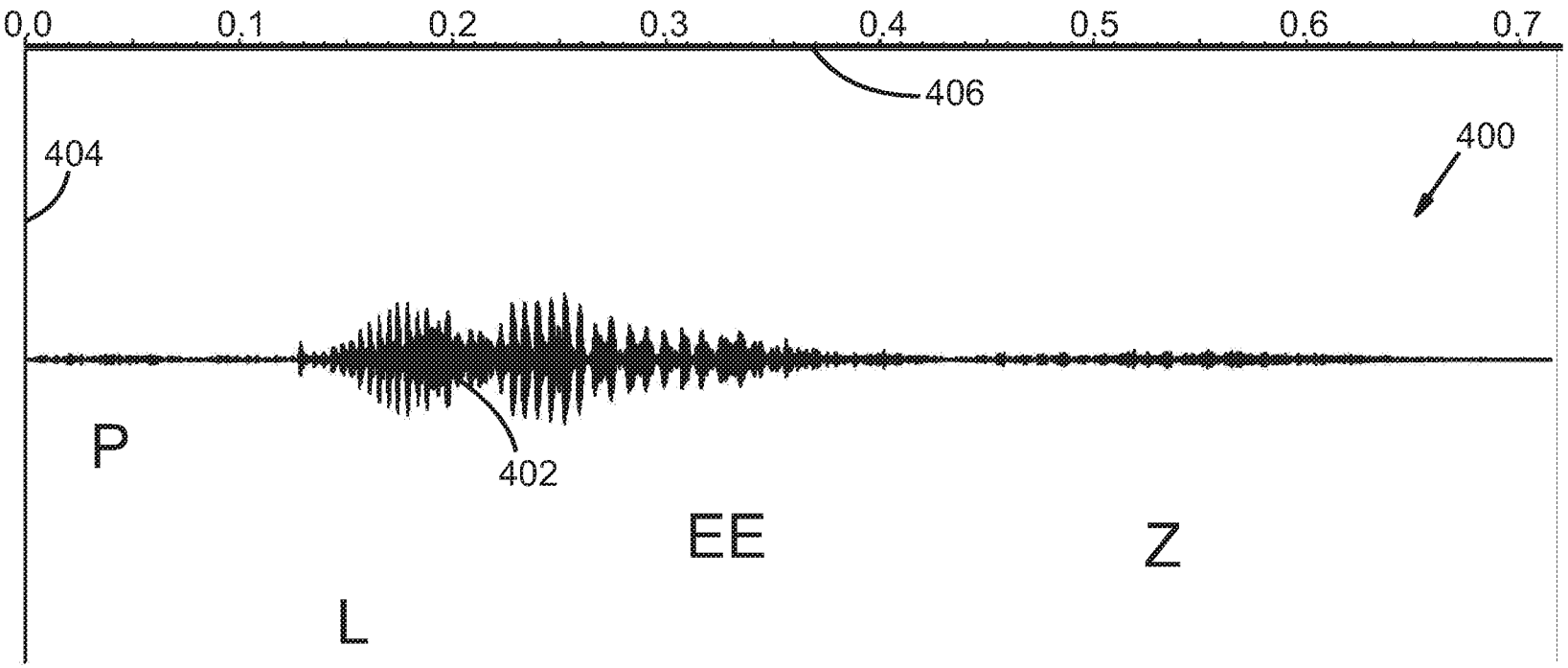
FIG. 4 illustrates an example waveform graph of a filtered signal.

FIG. 4 illustrates an example waveform graph 400 of a filtered signal 402. Filtered signal 402 is shown with an instantaneous sound pressure 404 plotted as function of time 406. Filtered signal 402 represents the result of filtering example first signal 202 from FIG. 2 according to the filter described in FIG. 3 which forms part of filtered volume determiner 104 of FIG. 1. In this embodiment, example first signal 202 from FIG. 2 has passed through a band pass filter which passed frequencies within a first range of frequencies (e.g. 2000 Hz to 2520 Hz). Those of ordinary skill in the art will appreciate that there are multiplicities of analog and digital systems, devices, circuits, methods, programming methods, approaches, and strategies to filter a signal according to the present disclosure.

Figure 5:
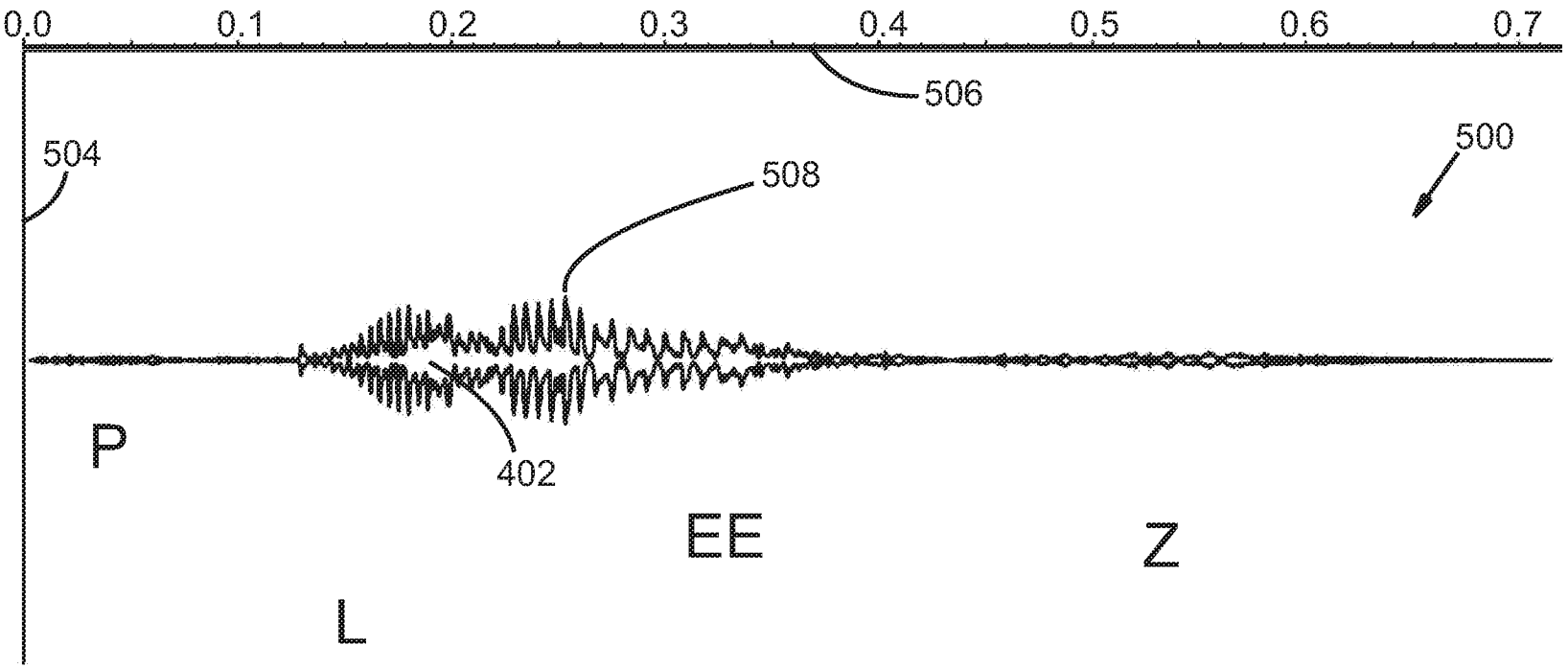
FIG. 5 illustrates an example waveform graph of a filtered signal and a volume envelope signal.

FIG. 5 illustrates an example waveform graph 500 of filtered signal 402 and a volume envelope signal 508. Filtered signal 402 and volume envelope signal 508 are shown with instantaneous sound pressure 504 plotted as function of time 506. Volume envelope signal 508 represents the result of determining the volume envelope of filtered signal 402. Volume envelope signal 508 represents an example output of filtered volume determiner 104 from FIG. 1. According to one embodiment, volume envelope signal 508 may be determined using a digital signal processing technique typically associated with a volume unit (VU) detector processing component. Those skilled in the art will appreciate that there are multiplicities of analog and digital systems, devices, circuits, methods, programming methods, approaches, and strategies to generate volume envelope signal 508. According to an embodiment, extraneous noise in volume envelope signal 508 shown has also been minimized with filtering techniques as previously described.

Figure 6:
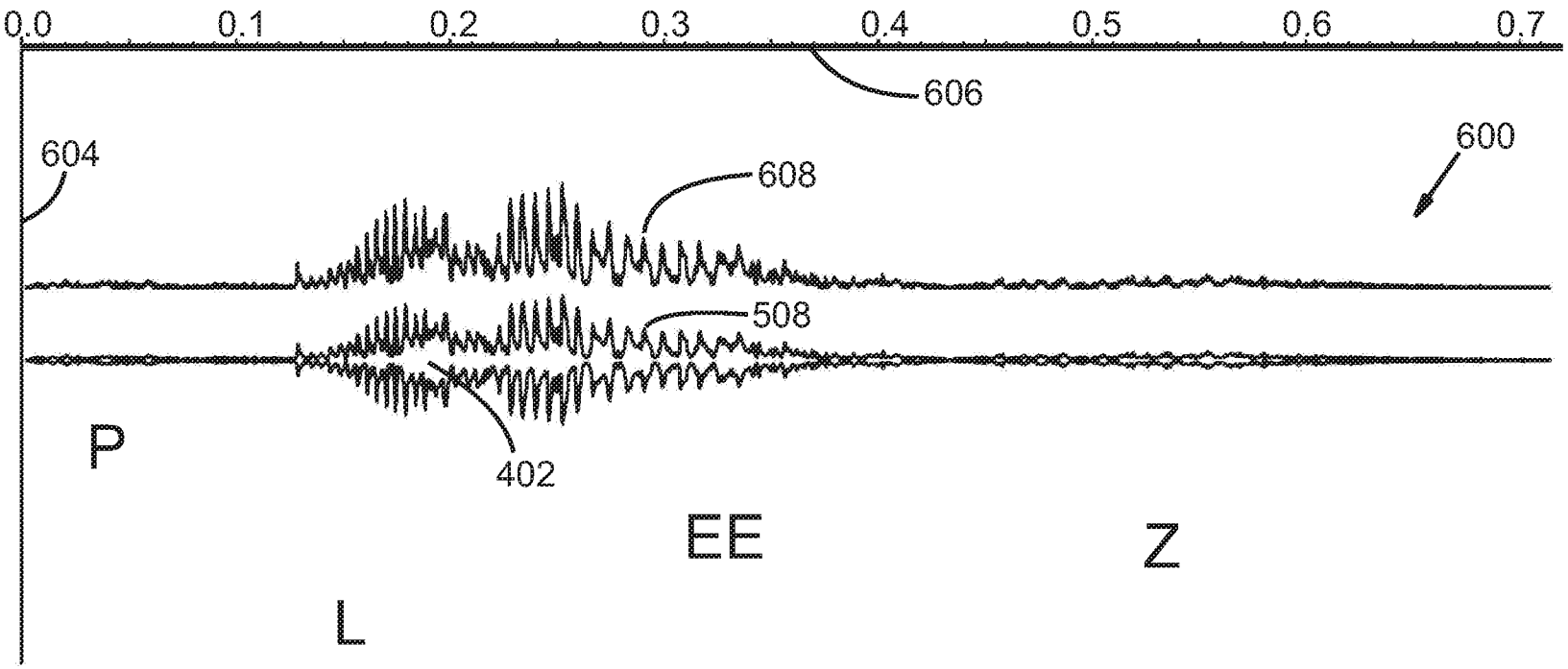
FIG. 6 illustrates an example waveform graph of a filtered signal, a volume envelope signal and a translated volume envelope signal.

FIG. 6 illustrates an example waveform graph 600 of filtered signal 402, volume envelope signal 508, and a translated volume envelope signal 608. According to one embodiment, translated volume envelope signal 608 can also be weighted. Filtered signal 402, volume envelope signal 508, and translated volume envelope signal 608 are shown with instantaneous sound pressure 604 plotted as function of time 606. According to one embodiment, translated volume envelope signal 608 represents the result of adding a fixed value to volume envelope signal 508. According to another embodiment, translated volume envelope signal 608 represents the result of multiplying volume envelope signal 508 by a first fixed value (i.e. weighting) and adding a second fixed value to the weighted volume envelope signal 508. Alternatively, translated volume envelope signal 608 can represent the result of adding a fixed value to volume envelope signal 508 and multiplying the sum by a second fixed value. Translated volume envelope 608 represents an example output of fixed volume adder 108 from FIG. 1. Those skilled in the art will appreciate that there are multiplicities of analog and digital systems, devices, circuits, methods, programming methods, approaches, and strategies to weight and/or translate volume envelope signal 508 to obtain a weighted and/or translated volume envelope signal 608.

Figure 7:
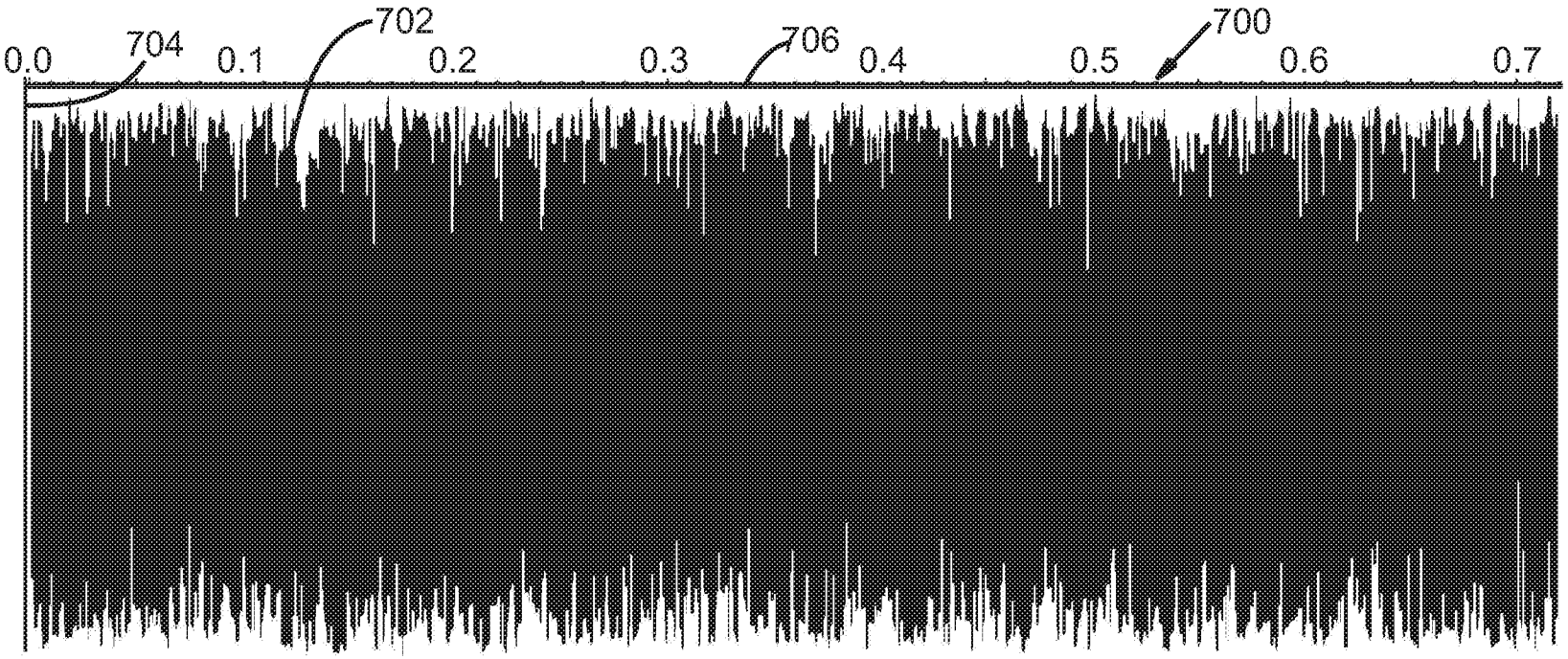
FIG. 7 illustrates an example waveform graph of a noise signal.

FIG. 7 illustrates an example waveform graph 700 of a noise signal 702. Noise signal 702 is shown with instantaneous sound pressure 704 plotted as a function of time 706. Noise signal 702 can be generated by filtered noise generator 112 from FIG. 1. Those skilled in the art will appreciate that there are multiplicities of analog and digital systems, devices, circuits, methods, programming methods, approaches, and strategies to generate a noise signal. Furthermore, various different types of noise signals can be generated, including but not limited to: a sound signal with a single fixed frequency and amplitude, a warbled tone, a chirping sound, a hiss, a rumble, a crackle, a hum, a popping sound, multiple tones, a signal having a randomly changing frequency and a randomly changing amplitude over time, incoherent noise, coherent noise, a combination of tones having random frequencies and random amplitudes, a combination of tones having random frequencies and fixed amplitudes, a random sound signal, uniformly distributed noise from a pseudo-random noise generator, "white noise," "pink noise," "Brownian noise" (i.e., "red noise"), and/or "Grey noise", etc. Furthermore, "noise" may also include a noise substantially within a range of frequencies wherein the noise comprises a signal having a substantially constant amplitude and having a randomly changing period corresponding to frequencies within a range of frequencies as described hereinafter. Furthermore, the randomly changing period can change as frequently as each cycle.

Figure 8:
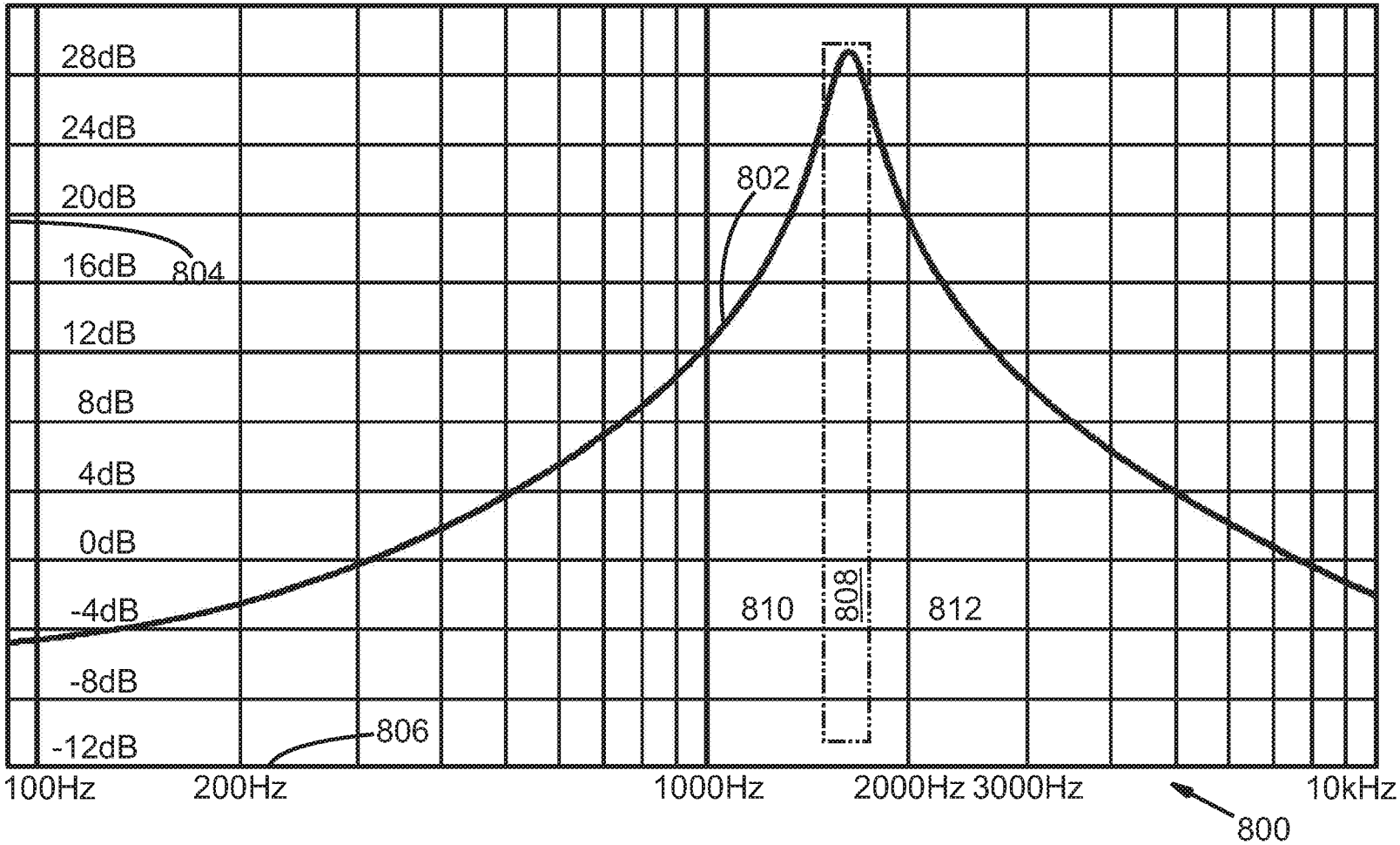
FIG. 8 illustrates a frequency response graph.

FIG. 8 illustrates a frequency response graph 800. Frequency response graph 800 indicates a second range of selected frequencies 808 (in this example: 1587 Hz to 1682 Hz) for filtered noise generator 112 (see FIG. 1). Frequency response graph 800 indicates a frequency response 802 as a function of gain 804 and frequency 806. It is noted that negative gain is often referred to as attenuation. According to an embodiment, frequency response 802 can be approximately equivalent to a Q-Factor biquad Equalizer Filter: with filter parameters: Fc=1,634 Hz, Q=7, Gain=35 dB, Scale=0.52483065332531. These filter parameters were selected to allow the filtered noise generator 112 to use, pass, or allow second range of selected frequencies 808 of a noise signal, such as noise signal 702, and to effectively restrict, reduce, or attenuate from a noise signal other frequencies 810 and/or 812. Those skilled in the art will recognize that there are multiplicities of filter combinations, types, orders, and filter parameters that may be used to accomplish similar objectives for second range of selected frequencies 808 which may be used for the generation of a filtered noise signal. For example, high pass and low pass filter types might be used including Linkwitz-Riley, Bessel, Chebychev, Cauer (elliptic), and the like. Alternately, band pass filters of sufficient width could be used. Furthermore, those skilled in the art will appreciate that the filters may include active, passive, digital, analog, mechanical, delay line, or other filter technologies. In some embodiments, second range of selected frequencies 808 may be selected to correspond to an individual's unique hearing loss, for example, second range of selected frequencies 808 may be selected to correspond to a band where a user has some remaining hearing. In other embodiments, second range of selected frequencies 808 may be determined by each individual's personal preference. In yet other embodiments, other strategies for the determination of second range of selected frequencies 808 have been described and will be readily apparent to those skilled in the art.

According to various embodiments, any of the filtered noise generators described herein can generate a noise signal which does not need to be subsequently filtered as shown in FIG. 8. For example, a filtered noise generator can be configured to generate a noise signal already having a power spectrum substantially within a selected range of frequencies. Such a noise signal may be subsequently filtered or may be used without subsequent filtering. Such a noise signal can be considered to be pre-filtered. An example of this type of noise signal is shown in FIG. 10 and FIG. 11.

Figure 9:
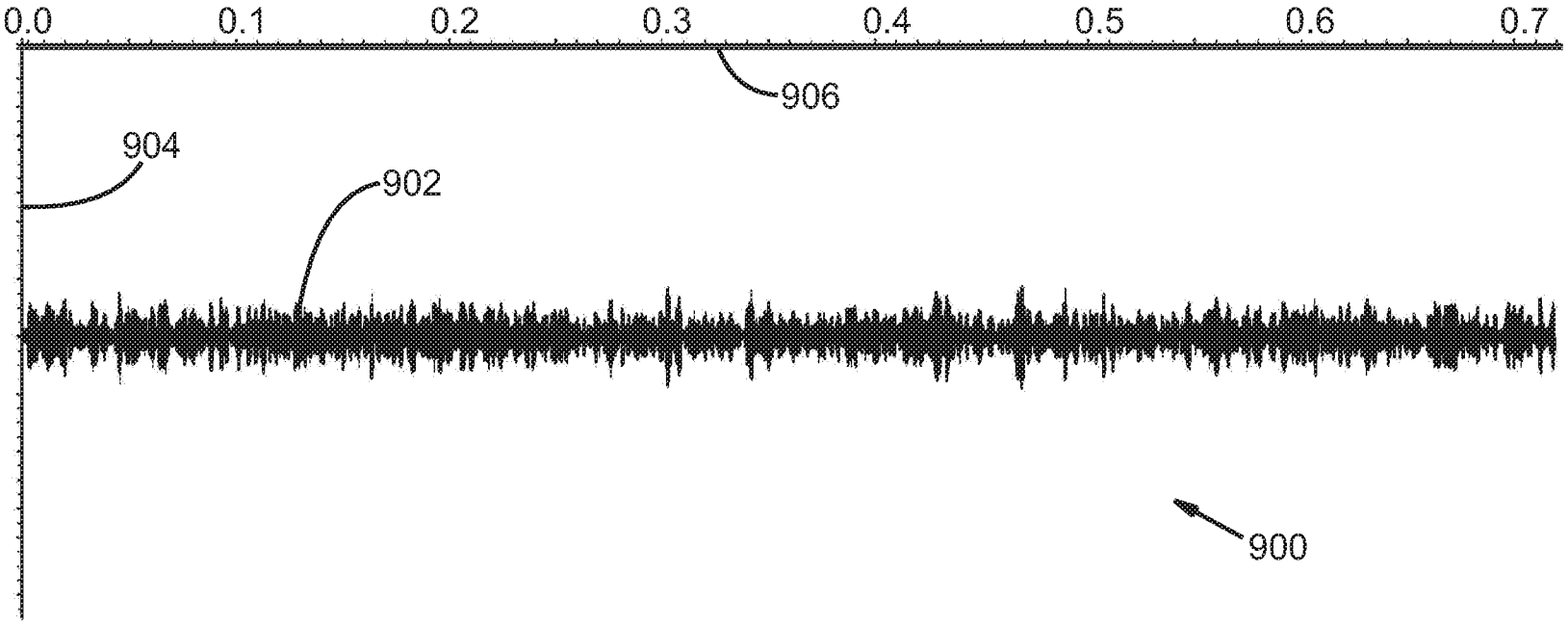
FIG. 9 illustrates an example waveform graph of a filtered noise signal.

FIG. 9 illustrates an example waveform graph 900 of a filtered noise signal 902. Filtered noise signal 902 is shown with an instantaneous sound pressure 904 plotted as function of time 906. Filtered noise signal 902 represents the result of filtering noise signal 702 from FIG. 7 according to the filter described in FIG. 8, which can form part of filtered noise generator 112 of FIG. 1. According to one embodiment, noise signal 702 from FIG. 7 has passed through a band pass filter which passed frequencies within a second range of frequencies (e.g. 1587 Hz to 1682 Hz). Those of ordinary skill in the art will appreciate that there are multiplicities of analog and digital systems, devices, circuits, methods, programming methods, approaches, and strategies to filter a signal according to the present disclosure.

Figure 10:
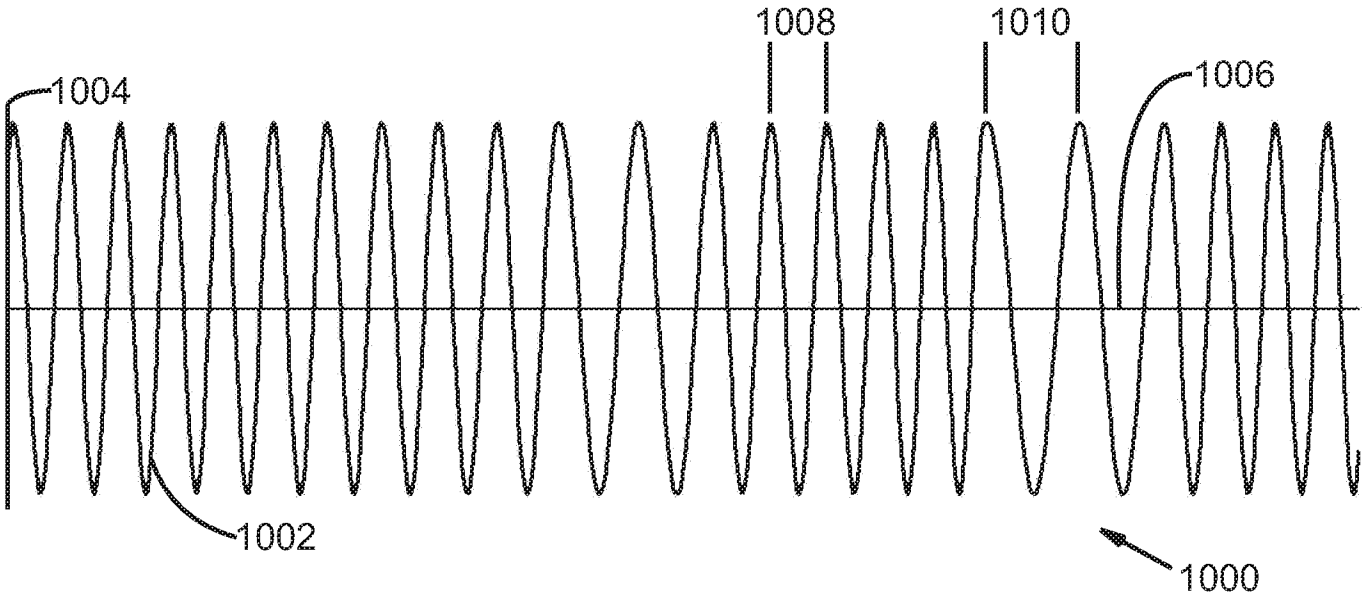
FIG. 10 illustrates an example waveform graph of a noise signal.

FIG. 10 illustrates a waveform graph 1000 of a noise signal 1002. Noise signal 1002 is shown with instantaneous sound pressure 1004 plotted as a function of time 1006. Noise signal 1002 illustrates another embodiment of a noise signal which can be generated by filtered noise generator 112 from FIG. 1. As shown, noise signal 1002 has a substantially constant amplitude and has randomly changing periods such as a first period 1008 and a second period 1010. Noise signal 1002 can be generated to comprise, generally, only frequencies substantially within a second range of frequencies or can be filtered to remove artifacts such that the random frequencies correspond, generally, only to frequencies only substantially within a second range of frequencies. It is noted then that filtered noise generator 112 does not necessarily perform a filtering function on all types of generated noise signals, as some noise signals can be generated to be generally within a particular range of frequencies and thus would not necessarily require subsequent filtering. Furthermore, the randomly changing period of the noise signal can change as frequently as each cycle.

Figure 11:
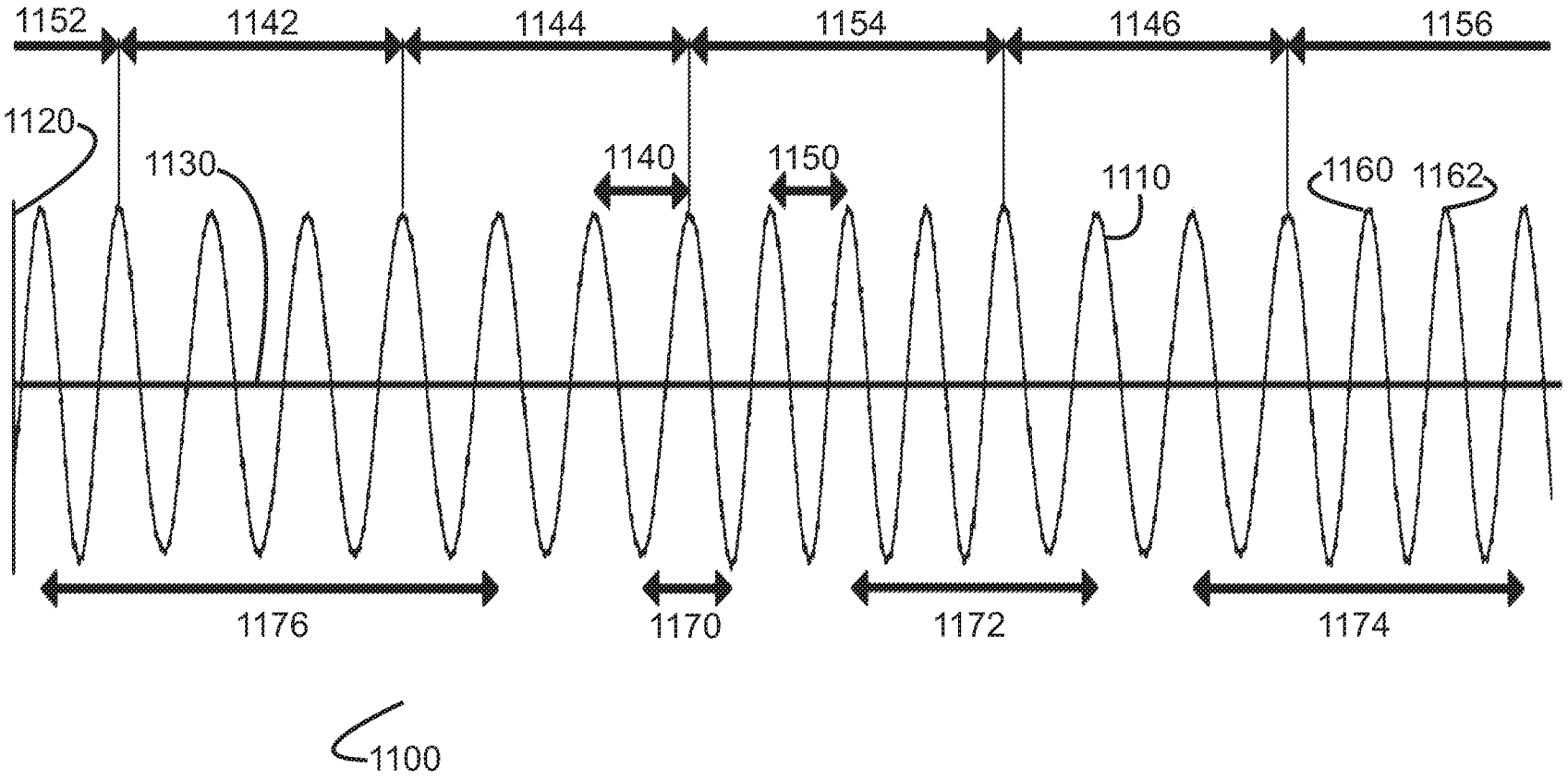
FIG. 11 illustrates an example waveform graph of a noise signal.

FIG. 11 illustrates a waveform graph 1100 of a noise, noise wave, parametrically formulated noise, or noise signal 1110. Noise signal 1110 is shown having an amplitude 1120 plotted as a function of time 1130. Noise signal 1110 illustrates another embodiment of a type of noise signal which can be generated by filtered noise generator 112 (see FIG. 1). Noise signal 1110 comprises a noise signal substantially within a second range of frequencies, generated by time ordering in a random or pseudo-random order, a plurality of periodic waves having frequencies within a second range of frequencies. According to an embodiment, parameters representing a ratio of duration for each of the plurality of periodic waves can be selected in order to control the power spectrum of noise signal 1110. According to an embodiment, noise signal 1110 can be a time ordered sequence of a first periodic wave having a first period or first frequency 1140 and a second periodic wave having a second period or second frequency 1150. It is noted that the period of a periodic wave can be related to its frequency by the equation: $f=1/T$, where f represents the frequency of the periodic wave and T represents the period of the periodic wave. According to other embodiments, noise signal 1110 may comprise three or more unique periodic waves, each having a unique period/frequency. According to the present embodiment, first period 1140 is a period equal to about 0.0005 seconds which represents a frequency of about 2000 Hz and second period 1150 is a period equal to about 0.00040625 seconds which represents a frequency of about 2462 Hz. According to an embodiment, each periodic wave can be a cosine wave beginning at 0 degrees, noted as 1160 in FIG. 11, and ending at 360 degrees, noted as 1162 in FIG. 11. Equivalently, each periodic wave can be a sine curve beginning at 90 degrees, noted as 1160 in FIG. 11, and ending at 450 degrees, noted as 1162 in FIG. 11. Those skilled in the art will recognize other equivalent or corresponding curves or waves that can be constructed, for example, a cosine wave formulated to begin at 360 degrees and end at 0 degrees, or a cosine wave formulated to begin at −180 degrees and end at +180 degrees, or a sine wave formulated to begin at −90 degrees and end at +270 degrees, etc.

Additional periodic waves having different periods are also created within noise signal 1110. For example, a third period 1170 comprises one half of first period 140 plus one half of second period 150. Third period 170 is a period equal to about 0.000453125 seconds ($0.000453125=(0.00040625+0.0005)/2$) which represents a frequency of about 2207 Hz. A fourth period 1172 comprises two periods of second period 1150 plus one period of first period 1140. Fourth period 1172 is a period equal to about 0.0013125 seconds ($0.0013125=(2\times0.00040625)+0.0005$) which represents a frequency of about 2286 Hz. Similarly, a fifth period 1174 would represent a frequency of about 2327 Hz and a sixth period 1176 would represent a frequency of about 2078 Hz. In accordance with an embodiment, noise signal 1110 can be, in general, a frequency-hopping plurality of periodic waves yielding a continuous spread-spectrum signal between the two frequencies, for example, between about 2000 Hz and about 2462 Hz. According to an embodiment, frequency hopping can be made to occur only at the periodic wave peaks, or alternatively only at periodic wave valleys, or only at either a periodic wave peak or a periodic wave valley.

In accordance with an embodiment, noise signal 1110 can comprise a time ordered, random or pseudo-random sequence of groups of either three consecutive first periodic waves, or four consecutive second periodic waves. For example, as shown, noise signal 1110 comprises a first group 1152 of waves having second period 1150, followed by a second group 1142 of three waves having a first period 1140, followed by a third group 1144 of three waves having a first period 1140, followed by a fourth group 1154 of four waves having a second period 1150, followed by a fifth group 1146 of three waves having a first period 1140, followed by a sixth group 1156 of waves having a second period 1150. First group 1152 and sixth group 1156 are only partially shown but if completed would correspond to fourth group 1154.

The duration of noise signal 1110 as shown in FIG. 11 if first group 1152 and sixth group 1156 were fully shown, is about 0.009375 seconds ($0.009375=(0.0015+0.001625)\times3$). According to various embodiments, parametrically formulated noise can be generally unaffected by constructive wave interference because of the unstable phase relationship of successive waves (incoherence). According to an embodiment, a noise signal representing a phoneme lasting a short period of time, for example 180 milliseconds, and constructed primarily with parametrically formulated noise would remain generally un-amplified by acoustic resonances within the ear canal due to the brief and incoherent nature of the noise signal.

While the occurrence of first and second periodic waves can be made random or pseudo-random, according to various embodiments, the ratio of the respective durations of various periodic waves over time within noise signal 1110 can be selected or set such that the power spectral density of noise signal 1110 is shaped according to the specific design of an audio system or device. For example, according to an embodiment, the ratio of duration of various periodic waves within a noise signal can be selected such that the average value of a power spectrum within a range of frequencies correlates to the threshold of hearing of an individual for a second range of frequencies. According to the present embodiment, the ratios of duration of the first and second periodic waves were selected such that the average amplitude of a power spectrum of the noise signal was substantially flat between 2000 Hz and 2462 Hz. According to the present embodiment, the time duration of a sequence of three first periodic waves of 2000 Hz is about 0.0015 seconds. The time duration of a sequence of four second periodic waves of 2462 Hz is about 0.001625 seconds. According to this embodiment, the duration of the sequence of four second periodic waves of 2462 Hz is about 8.33% longer than the duration of the sequence of three first periodic waves of 2000 Hz. Assuming that the sequences of three first periodic waves are selected randomly or pseudo-randomly with the same probability as sequences of four second periodic waves, then the duration of second periodic waves of 2462 Hz over time will generally be about 1.0833 times longer than the duration of first periodic waves of 2000 Hz over time (1.0833=0.001625/0.0015). Accordingly, this embodiment demonstrates a parametrically formulated noise wherein a parameter or plurality of parameters, representing the ratio of duration for each of a plurality of periodic waves, were selected by design such that the average power spectrum amplitude within a second range of frequencies of the parametrically formulated noise is shaped according to the selected parameters. In this embodiment, the average power spectrum amplitude of the parametrically formulated noise signal at 2462 Hz would generally only be about 0.7 decibels (hereinafter: dB) louder than at 2000 Hz (0.7 dB=20 log 1.0833). Furthermore, according to an embodiment, the average power spectrum amplitude between 2000 Hz and 2462 Hz may not vary significantly from the average power spectrum amplitude at 2000 Hz or at 2462 Hz. Lastly, because the sequences of period waves of such parametrically formulated noise are presented in random or pseudo-random order, the parametrically formulated noise can be generated and output from an audio device or system, such as a hearing aid, having a speaker and microphone without the problems or issues associated with feedback.

Thus, according to various embodiments, a parametrically formulated noise signal can be generated wherein the average power spectrum amplitude within a range of frequencies over time is generally shaped or controlled. Parameters, such as the period/frequency and/or the number of periodic waves per sequence can be used to determine the general ratios of duration of each periodic wave over time. The parameters representing the ratios of duration of each periodic wave over time can be used to shape the average power spectrum amplitude of a noise signal across a range of frequencies. According to various embodiments, a parametrically formulated noise generator, or a plurality of parametrically formulated noise generators, can create a parametrically formulated noise signal, or sum of multiple individual parametrically formulated noise signals, which can be shaped across the acoustical frequency spectrum, or shaped across a portion of the acoustical frequency spectrum, to correlate generally to the threshold of hearing of an individual across the frequency spectrum or a portion of the frequency spectrum. For example, the average power spectrum amplitude of a parametrically formulated noise signal across the acoustical frequency spectrum, or a portion of the acoustical frequency spectrum, could be shaped to fall just below an individual's threshold of hearing across the acoustical frequency spectrum, or portion of the acoustical frequency spectrum. Such parametrically formulated noise signal would generally be inaudible to the individual, however, such parametrically formulated noise signal would enable increased speech understanding and speech intelligibility when mixed with an audio signal containing speech or when mixed with speech sounds or when modulated by an audio signal containing speech information. The following formulas are instructive for selecting parameters for generating such a controlled and/or shaped noise signal:

The ratios of duration of the different periodic waves within a parametrically generated noise signal are given by:

$$R_1 = (N_1 \times P_1)/((N_1 \times P_1) + (N_2 \times P_2) + \ldots + (N_N \times P_N))$$

$$R_2 = (N_2 \times P_2)/((N_1 \times P_1) + (N_2 \times P_2) + \ldots + (N_N \times P_N))$$

$$\ldots$$

$$R_N = (N_N \times P_N)/((N_1 \times P_1) + (N_2 \times P_2) + \ldots + (N_N \times P_N))$$

where:

$P_1$=360° period for the $1^{st}$ periodic wave=1/Frequency of the $1^{st}$ periodic wave;

$P_2$=360° period for the $2^{nd}$ periodic wave=1/Frequency of the $2^{nd}$ periodic wave;

$P_N$=360° period for the $N^{th}$ periodic wave=1/Frequency of the $N^{th}$ periodic wave;

$N_1$=Number of $1^{st}$ periodic waves per sequence;

$N_2$=Number of $2^{nd}$ periodic waves per sequence;

$N_N$=Number of $N^{th}$ periodic waves per sequence;

$R_1$=Ratio of duration for the $1^{st}$ periodic wave $R_2$=Ratio of duration for the $2^{nd}$ periodic wave $R_n$=Ratio of duration for the $N^{th}$ periodic wave The ratio of duration between any two periodic waves A and B ($R_{AB}$) is then given by: $R_{AB}=R_A/R_B$ The gain in dB for the power spectrum amplitude of the noise signal between any two frequencies A and B ($G_{AB}$) where frequency A corresponds to the frequency of a periodic wave A (1/period of periodic wave A), and frequency B corresponds to the frequency of a periodic wave B (1/period of periodic wave B), would then generally be given by: $G_{AB}=20\times\log_{10}(R_A/R_B)$ Those skilled in the art will realize that the power spectrum amplitude levels of the noise signal can be controlled to be a function of frequency and can be designed by using different ratios of duration for the various periodic waves used. Those skilled in the art will realize that the examples and embodiments presented herein are illustrative for simplicity sake and are not necessarily optimized. Furthermore, according to various embodiments, other methods of randomization or pseudo-randomization can be used to weight or distribute the probability of occurrence of each periodic wave such that the desired ratio of duration for each periodic wave within a noise signal can be selected, controlled or influenced. Embodiments utilizing such techniques may not need to have different numbers of periodic waves per sequence for each periodic wave imposed. According to an embodiment, techniques such as error diffusion could be used. Additionally, those skilled in the art will realize that there many possible sampling frequencies that may be used with corresponding periodic waves and frequencies that may be designed to meet the criteria to create suitable parametrically formulated noise.

Figure 12:
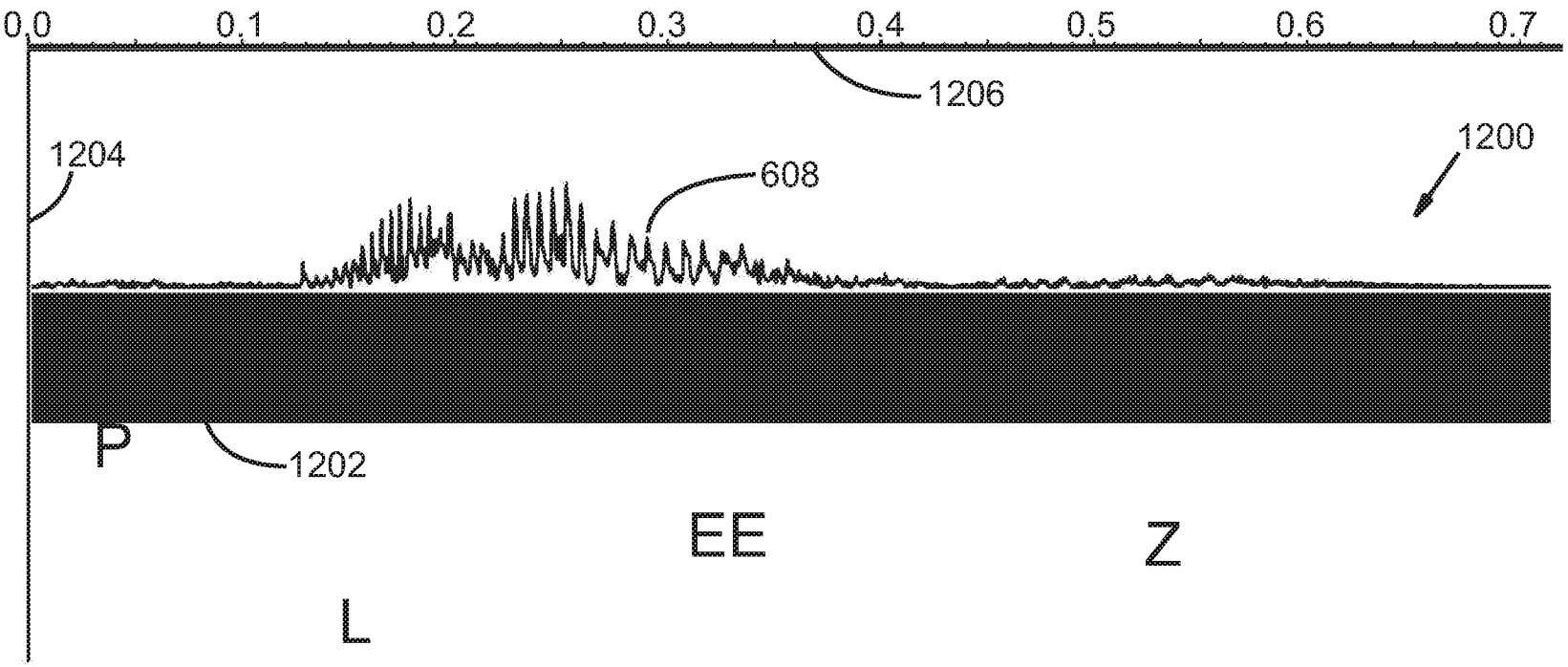
FIG. 12 illustrates an example waveform graph of a translated volume envelope signal and a filtered noise signal.

FIG. 12 illustrates an example waveform graph 1200 of translated volume envelope signal 608 and a filtered noise signal or a weighted filtered noise signal 1202. Filtered noise signal 1202 may represent a filtered noise signal such as filtered noise signal 902 (see FIG. 9) or may represent a filtered noise signal such as filtered noise signal 1002 (see FIG. 10) or filtered noise signal 1110 (see FIG. 11). The amplitude of filtered noise signal 1202 is not drawn to scale so as not to obscure translated volume envelope signal 608 in the figure. Furthermore, filtered noise signal 1202 is shown as having a substantially constant amplitude similar to filtered noise signals 1002 and 1110, if a filtered noise signal similar to filtered noise signal 902 had been used, there would be more variance in the amplitude of filtered noise signal 1202. Filtered noise signal 1202 appears as a solid bar due to the limitation of resolution of the drawing itself. According to an embodiment, filtered noise signal 1202 may comprise more than 1000 periods of a periodic wave or a plurality of periodic waves over the 0.7 second time frame shown in FIG. 12. Translated volume envelope signal 608 and filtered noise signal 1202 are shown with instantaneous sound pressure 1204 plotted as function of time 1206. Translated volume envelope signal 608 can represent translated volume envelope signal 608 from FIG. 6 which can be inputted into signal modulator 116 from FIG. 1. Filtered noise signal 1202 can represent a filtered noise signal which could be outputted from filtered noise generator 112 and inputted into signal modulator 116 from FIG. 1. As with all signals described in this patent, filtered noise signal 1202 may be a weighted signal. For example, filtered noise signal 902 from FIG. 9 could be weighted in order to increase or decrease the average amplitude of the filtered noise signal in order to produce filtered noise signal 1202. Alternatively, filtered noise signal 1002 from FIG. 10 could be weighted in order to increase or decrease the average amplitude of the filtered noise signal in order to produce filtered noise signal 1202. In yet another embodiment, a noise signal can be generated with an amplitude such that no weighting is required in order to produce filtered noise signal 1202.

Figure 13:
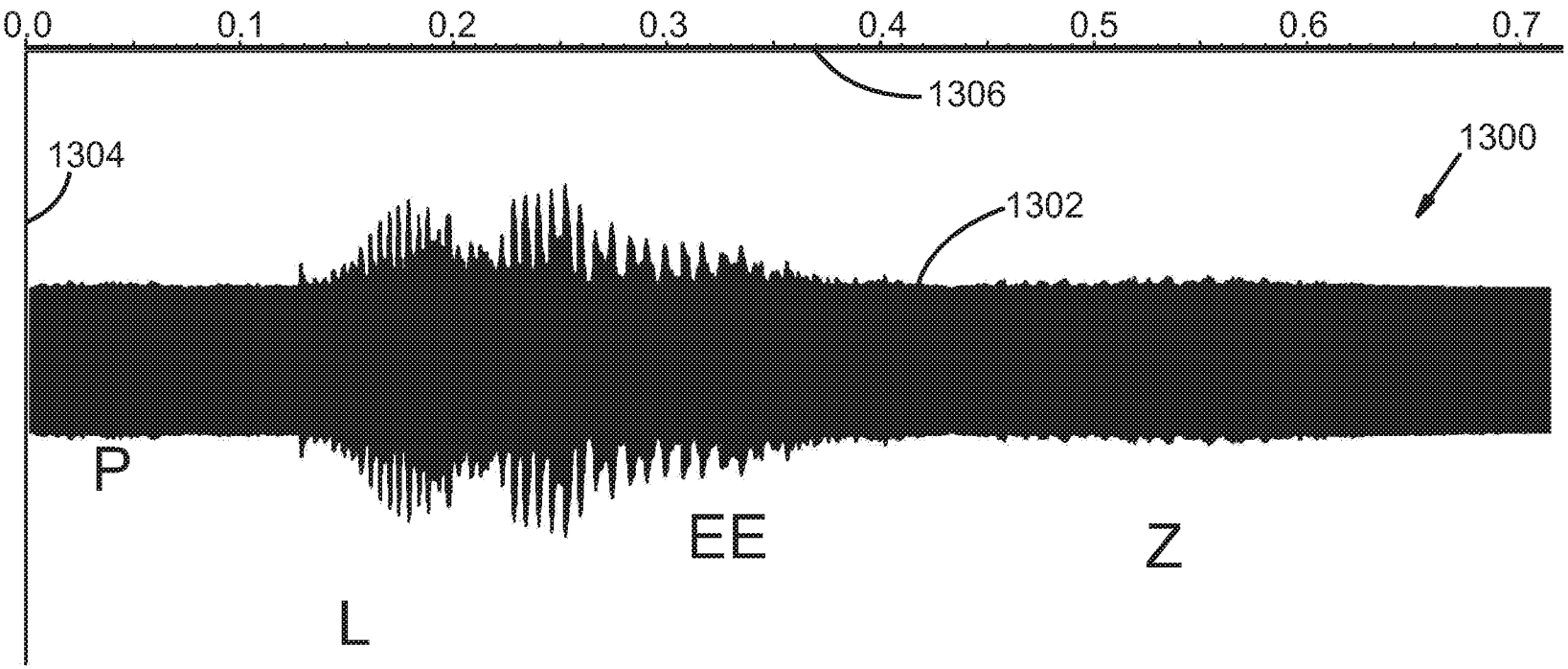
FIG. 13 illustrates an example waveform graph of a modulated noise signal.

FIG. 13 illustrates an example waveform graph 1300 of a modulated noise signal 1302. Modulated noise signal 1302 is shown with instantaneous sound pressure 1304 plotted as function of time 1306. Modulated noise signal 1302 illustrates an example of a signal outputted from signal modulator 116 from FIG. 1. According to an embodiment, modulated noise signal 1302 may comprise one or more the following characteristics:

a.) Modulated noise signal 1302 may be a noise signal comprised of frequencies from a selected second range of frequencies;

b.) The volume envelope of modulated noise signal 1302 may be shaped substantially similar to a volume envelope or a weighted volume envelope of a first signal within a first range of selected frequencies. For example, a volume envelope of first signal 102 of FIG. 1 within a first range of selected frequencies; or, c.) The volume envelope of modulated noise signal 1302 may be boosted, lifted, weighted, or translated such that the variations of the volume envelope of modulated noise signal 1302 are above a user's threshold of hearing within the second range of frequencies.

Figure 14:
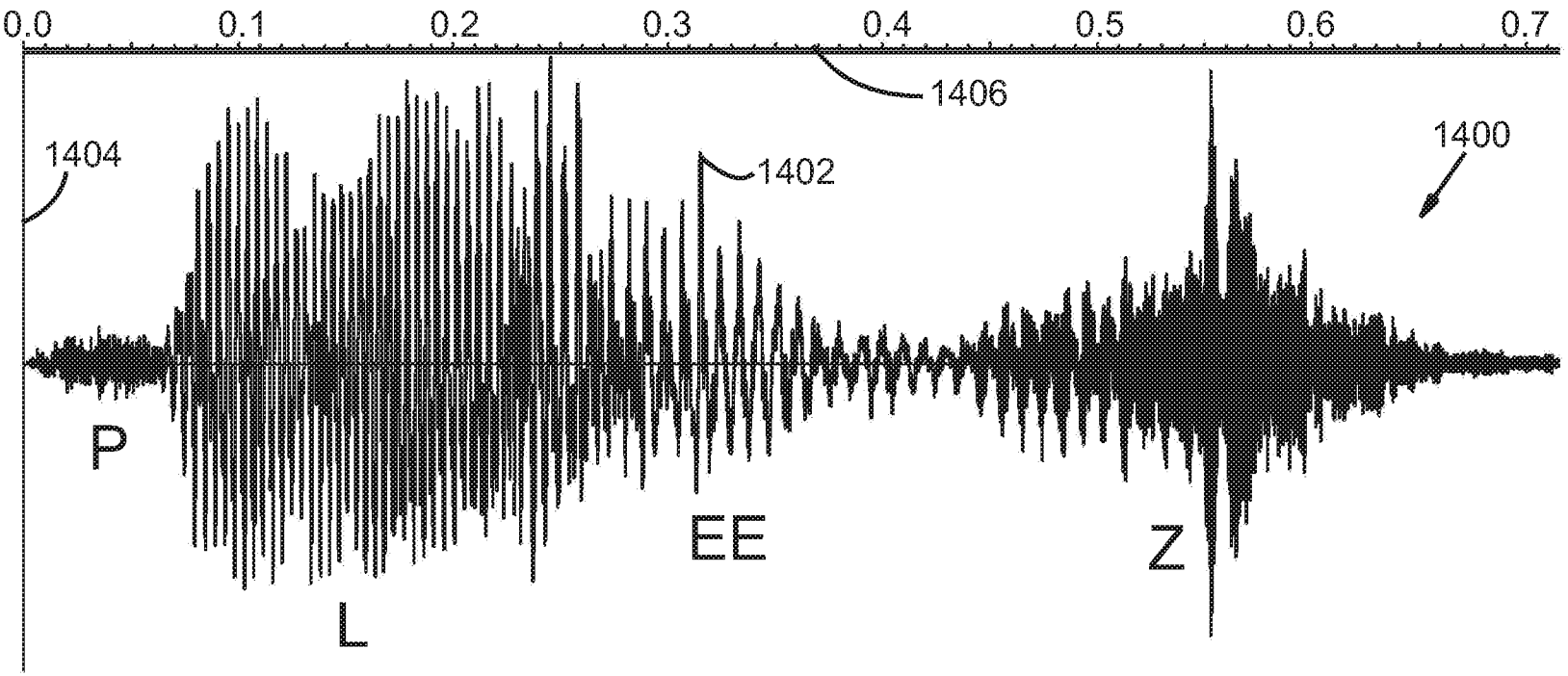
FIG. 14 illustrates an example waveform graph of an example signal.

FIG. 14 illustrates an example waveform graph 1400 of an example signal 1402. Example signal 1402 is shown with an instantaneous sound pressure 1404 plotted as a function of time 1406. Example signal 1402 is shown as substantially similar to example first signal 202 from FIG. 2. According to an embodiment, example signal 1402 is the same signal as example first signal 202. Example signal 1402 could be produced with a splitter which splits an original signal into example first signal 202 and example signal 1402. Other systems, devices and methods are known to split or reproduce a signal as well. It is noted that, example signal 1402 may be modified according to generally known speech intelligibility improvement techniques such as WDRC and AGC (not shown). Modification of example signal 1402 in this manner may occur before the signal is presented to filtered volume reducer 122 or at a subsequent point. Furthermore, known speech intelligibility improvement techniques such as WDRC and AGC can be applied to the signal outputted from mixer 126.

Figure 15:
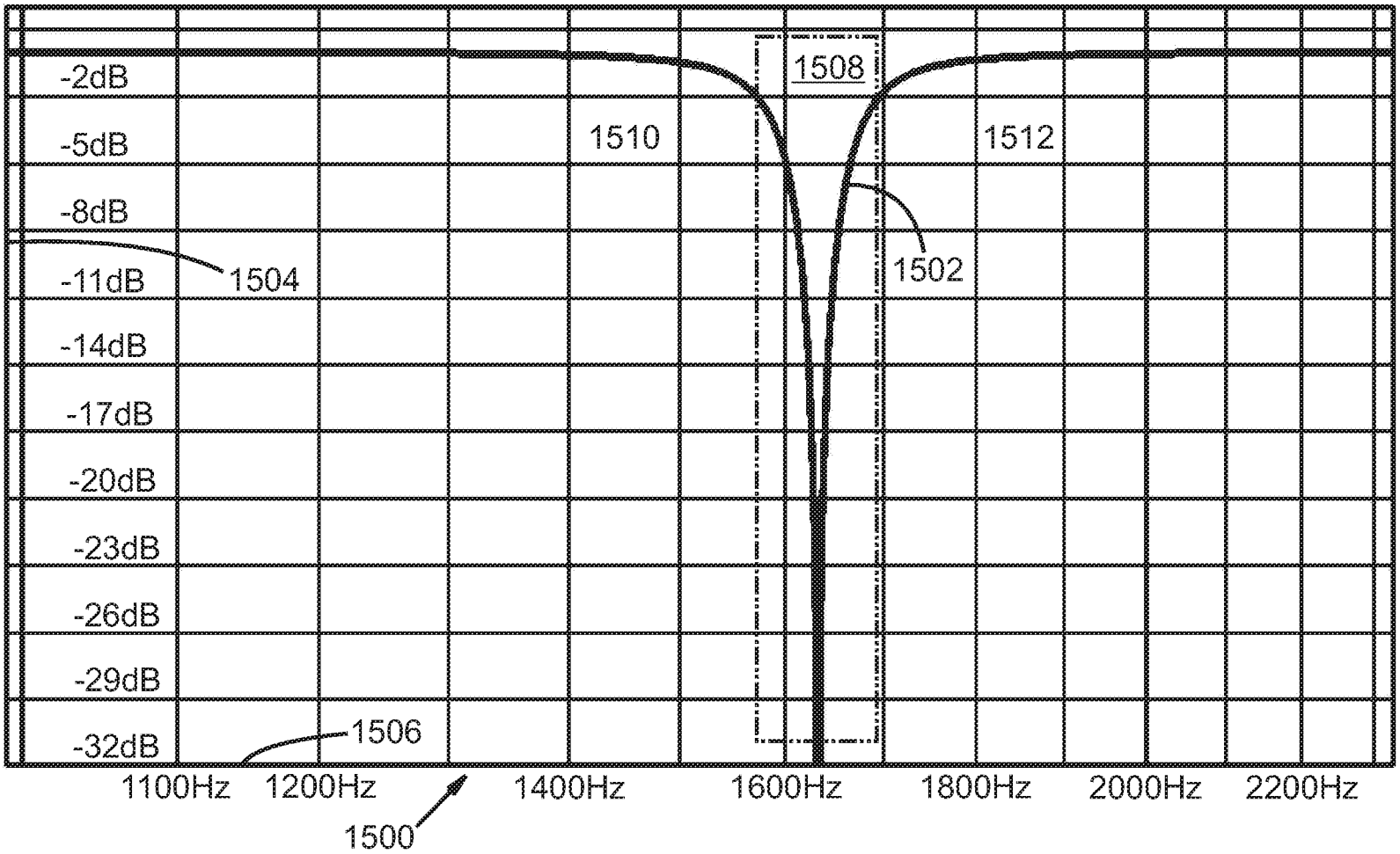
FIG. 15 illustrates a frequency response graph.

FIG. 15 illustrates a frequency response graph 1500. Frequency response graph 1500 indicates a third range of selected frequencies 1508. According to an embodiment third range of selected frequencies 1508 can comprise frequencies from about 1587 Hz to about 1682 Hz as shown. It is noted that third range of selected frequencies 1508 may be substantially the same as a second range of selected frequencies, for example second range of selected frequencies 808 (see FIG. 8), or according to other embodiments, third range of selected frequencies 1508 may be overlapping or different from a second range of selected frequencies. According to an embodiment, filtered volume reducer 122 (see FIG. 1) may filter out a third range of frequencies, for example, third range of selected frequencies 1508. According to an embodiment, filtered volume reducer 122 can filter out a third range of selected frequencies using a low pass filter (see for example, FIGS. 18 and 19) which could filter out frequencies from, for example, about 1587 Hz and above. According to an embodiment, third range of selected frequencies 1508 may be selected to correspond to a band where a user has some remaining hearing. According to another embodiment, third range of selected frequencies 1508 may be determined by an individual's personal preference. In another embodiment, filtered volume reducer 122 may generate a filtered example signal, for example, filtered example signal 1602 (See FIG. 16) with restricted sound frequencies in order to also reduce total sound energy to satisfy safety criteria for time dependent noise exposure which may consequently reduce additional noise induced hearing loss. In still another embodiment, filtered volume reducer 122 may generate a signal with restricted sound frequencies in order to also reduce sound without significant speech information content and thus assist word recognition in otherwise noisy sound environments. In yet other embodiments, other strategies for the determination of third range of selected frequencies 1508 have been described and will be apparent to those skilled in the art.

Frequency response graph 1500 indicates a frequency response 1502 as a function of gain 1504 and frequency 1506. It is noted that negative gain can be referred to as attenuation. This particular frequency response 1502 is equivalent to a biquad notch filter: with filter parameters: Fc=1,634 Hz, Scale=1.0, and a bandwidth=95 Hz. These filter parameters were selected to allow filtered volume reducer 122 to filter out third range of selected frequencies 1508 from example signal 1402 (see FIG. 14). Those skilled in the art will recognize that there are multiplicities of filter combinations, types, orders, and filter parameters that may be used to accomplish similar objectives for third range of selected frequencies 1508. For example, high pass and low pass filter types might be used including Linkwitz-Riley, Bessel, Chebychev, Cauer (elliptic), and the like. Alternately, notch filters of sufficient width could be used. Furthermore, those skilled in the art will appreciate that the filters may include active, passive, digital, analog, mechanical, delay line, or other filter technologies.

Figure 16:
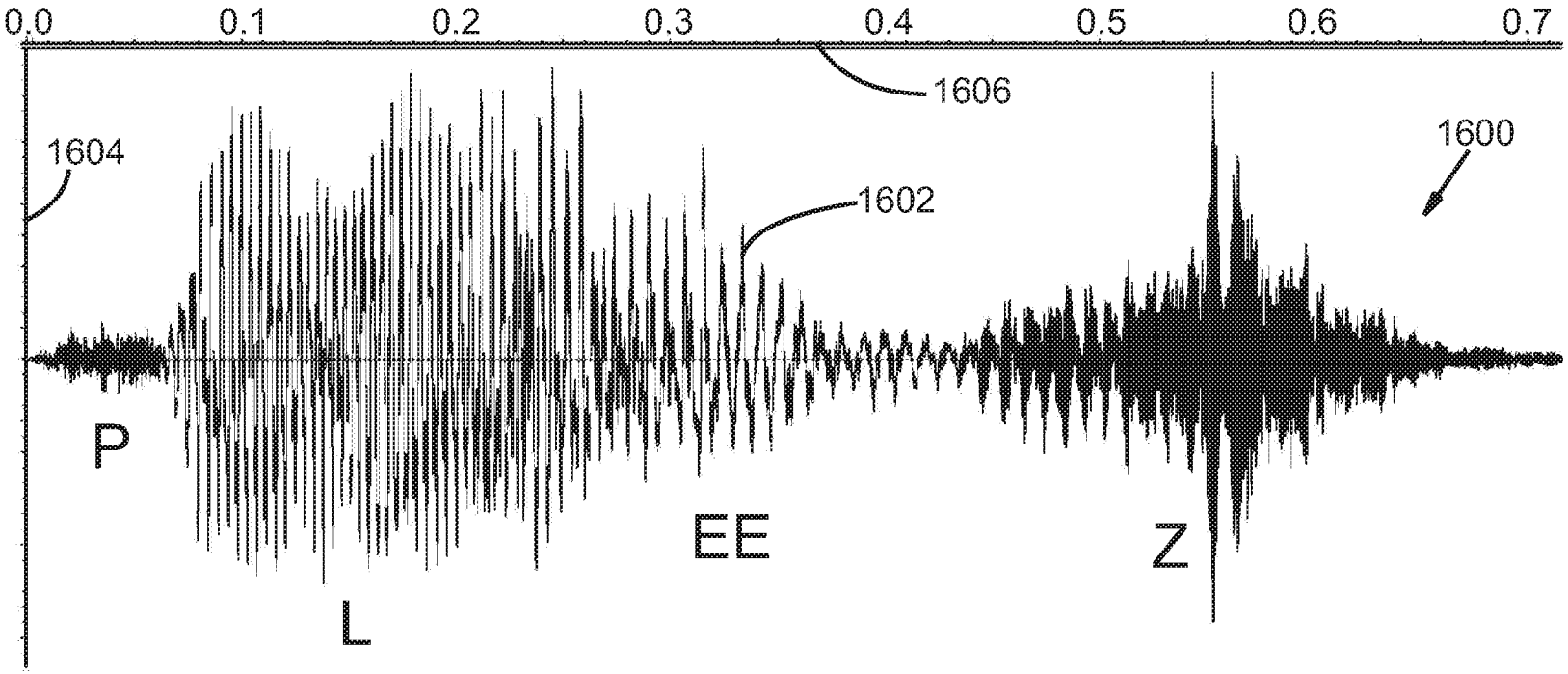
FIG. 16 illustrates an example waveform graph of a filtered example signal.

FIG. 16 illustrates an example waveform graph 1600 of a filtered example signal 1602. Filtered example signal 1602 is shown with an instantaneous sound pressure 1604 plotted as a function of time 1606. Filtered example signal 1602 represents an example result of filtering example signal 1402 from FIG. 14 according to the filter described in FIG. 15 which can form part of filtered volume reducer 122 of FIG. 1 according to an embodiment. According to an embodiment, example signal 1402 from FIG. 14 can have passed through a notch filter which filtered out frequencies within a third range of frequencies, for example, third range of selected frequencies 1508 (see FIG. 15). According to one embodiment third range of selected frequencies can be from about 1587 Hz to about 1682 Hz. Those of ordinary skill in the art will appreciate that there are multiplicities of analog and digital systems, devices, circuits, methods, programming methods, approaches, and strategies to filter a signal.

Figure 17:
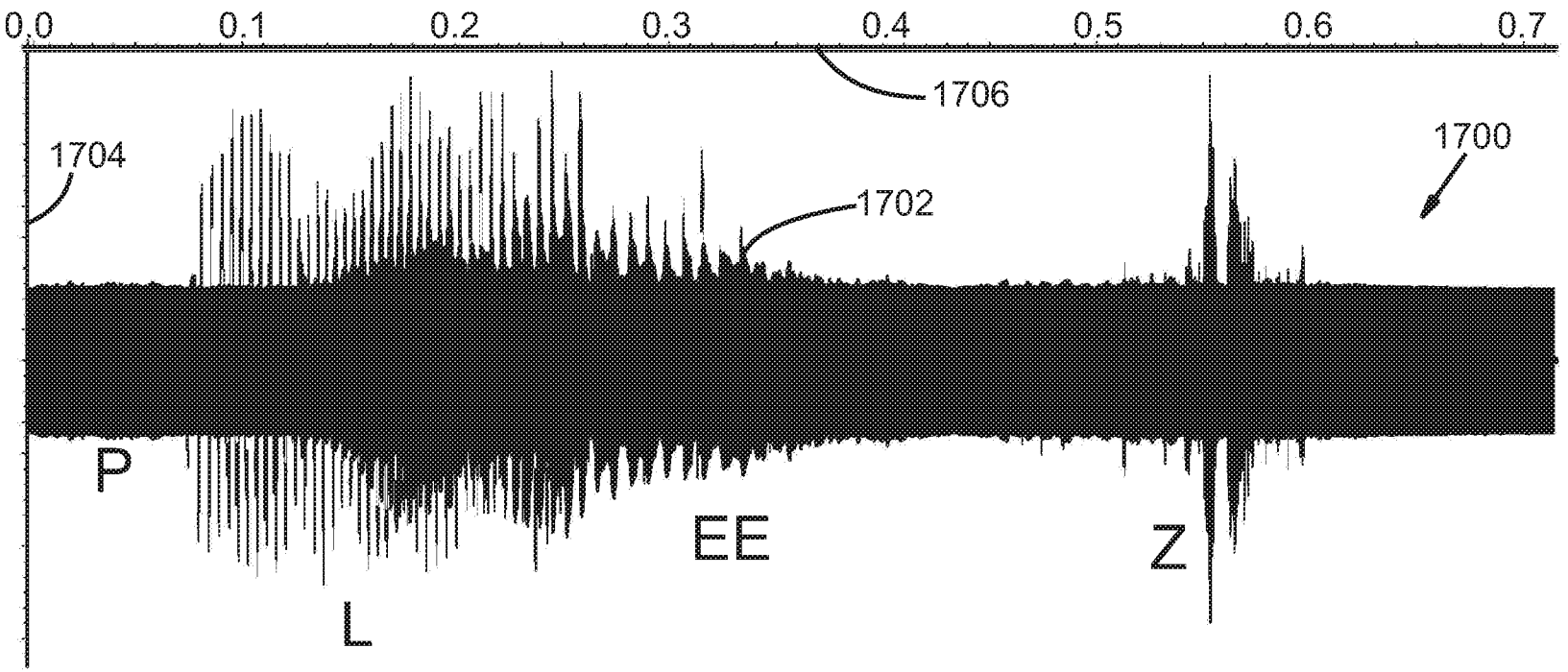
FIG. 17 illustrates an example waveform graph of a noise enhanced example signal.

FIG. 17 illustrates an example waveform graph 1700 of a noise enhanced example signal 1702. Noise enhanced example signal 1702 is shown with instantaneous sound pressure 1704 plotted as function of time 1706. According to an embodiment, filtered example signal 1602 (see FIG. 16) can be outputted from filtered volume reducer 122 (see FIG. 1) and inputted into mixer 126 (see FIG. 1). Furthermore, modulated noise signal 1302 (see FIG. 13) can be outputted from signal modulator 116 (see FIG. 1) and inputted into mixer 126. Mixer 126 can add or mix filtered example signal 1602 with modulated noise signal 1302 to generate noise enhanced example signal 1702. Mixing or summing of signals can be done, for example, by adding the instantaneous sound pressure level of one signal to the instantaneous sound pressure level of another signal at each instant in time. Mixing can also be accomplished via digital, analog and mechanical techniques, such as air conduction mixing, addition of digital signals, multiplication of digital signals, summing of analog signals, multiplication of analog signals, etc.

Figure 18:
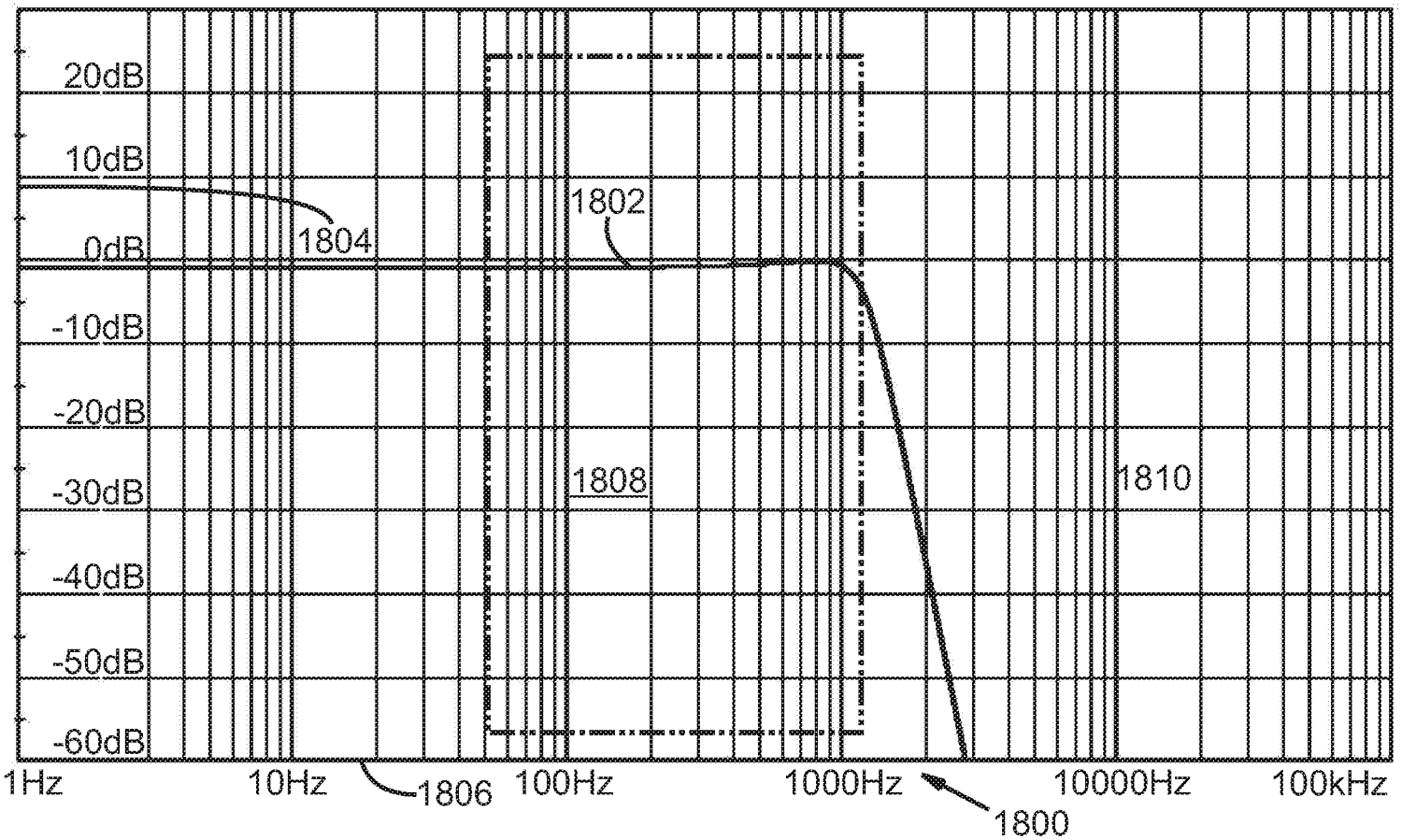
FIG. 18 illustrates a frequency response graph.

FIG. 18 illustrates a frequency response graph 1800. Frequency response graph 1800 indicates a third range of selected frequencies 1808 (in this example: about 50 Hz to about 1200 Hz) which could be used for a filtered volume reducer, for example, filtered volume reducer 122 (see FIG. 1). It is noted that third range of selected frequencies 1808 may be substantially the same as the second range of selected frequencies or according to other embodiments, the third range of selected frequencies may be overlapping or different from the second range of selected frequencies. As shown, third range of selected frequencies 1808 represents a low pass filtering which can filter out frequencies from, for example, about 1200 Hz and above. According to an embodiment, third range of selected frequencies 1808 may be selected to correspond to a band where a user has some remaining hearing. According to another embodiment, third range of selected frequencies 1808 may be determined by each individual's personal preference. In another embodiment, filtered volume reducer 122, or comparable filtered volume reducers described herein, may generate a filtered example signal with restricted sound frequencies in order to reduce total sound energy to satisfy safety criteria for time dependent noise exposure which may consequently reduce additional noise induced hearing loss. In still another embodiment, filtered volume reducer 122 may generate a signal with restricted sound frequencies in order to also reduce sound without significant speech information content and thus assist word recognition in otherwise noisy sound environments. In yet other embodiments, other strategies for the determination of third range of selected frequencies 1808 have been described and will be apparent to those skilled in the art.

Frequency response graph 1800 indicates a frequency response 1802 as a function of gain 1804 and frequency 1806. It is noted that negative gain can be referred to as attenuation. Those skilled in the art will recognize that there are multiplicities of filter combinations, types, orders, and filter parameters that may be used to accomplish similar objectives for third range of selected frequencies 1808. For example, high pass and low pass filter types might be used including Linkwitz-Riley, Bessel, Chebychev, Cauer (elliptic), and the like. Alternately, notch filters of sufficient width could be used. Furthermore, those skilled in the art will appreciate that the filters may include active, passive, digital, analog, mechanical, delay line, or other filter technologies.

Figure 19:
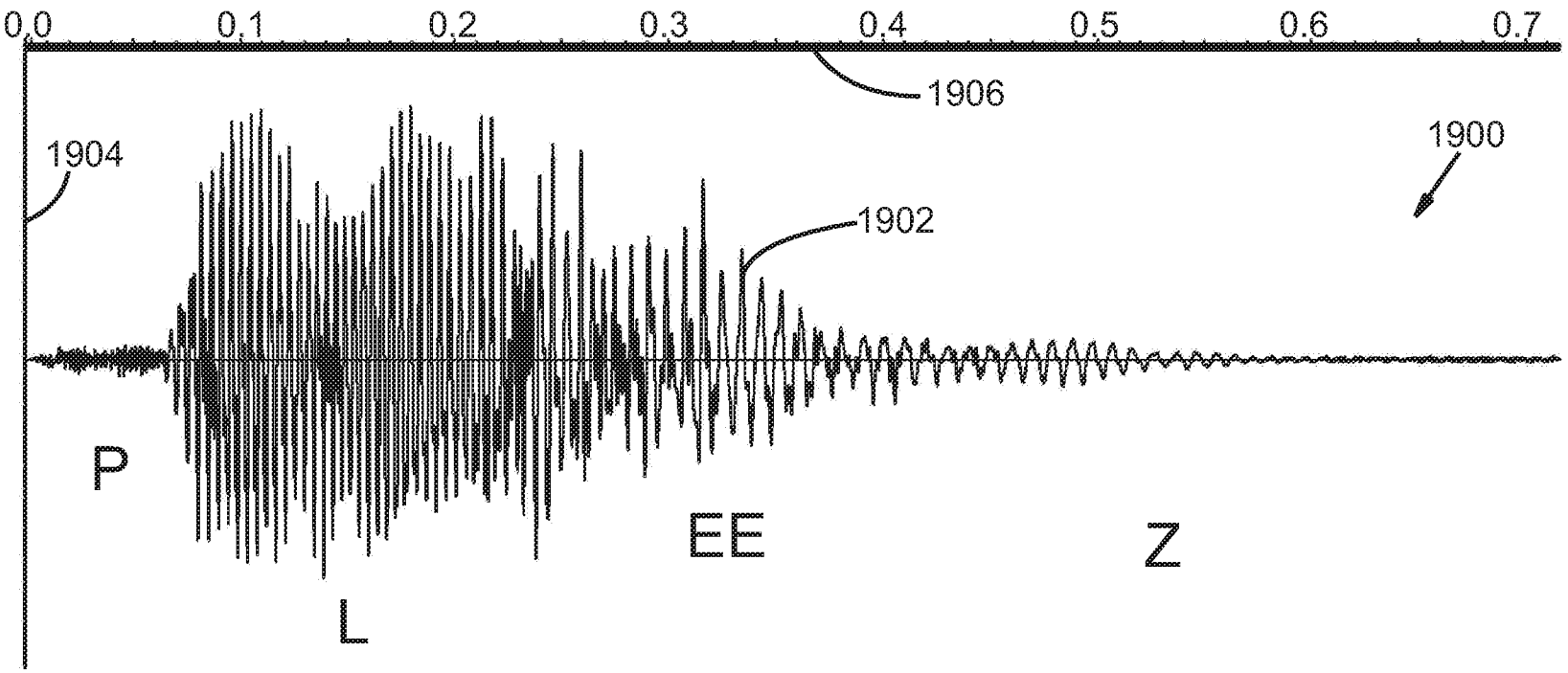
FIG. 19 illustrates an example waveform graph of a filtered example signal.

FIG. 19 illustrates an example waveform graph 1900 of a filtered example signal 1902. Filtered example signal 1902 is shown with an instantaneous sound pressure 1904 plotted as a function of time 1906. According to an embodiment, filtered signal 1902 represents an example result of filtering example first signal 202 from FIG. 2, or example signal 1402 from FIG. 14, or a similar signal, according to the filter described in FIG. 18 which can form part of a filtered volume reducer, for example, filtered volume reducer 122. According to an embodiment, example first signal 202 from FIG. 2 or example signal 1402 from FIG. 14 has passed through a low pass filter which filtered out frequencies within a third range of frequencies 1808 (see FIG. 18), for example, from about 50 Hz to about 1200 Hz. Those of ordinary skill in the art will appreciate that there are multiplicities of analog and digital systems, devices, circuits, methods, programming methods, approaches, and strategies to filter a signal.

Figure 20:
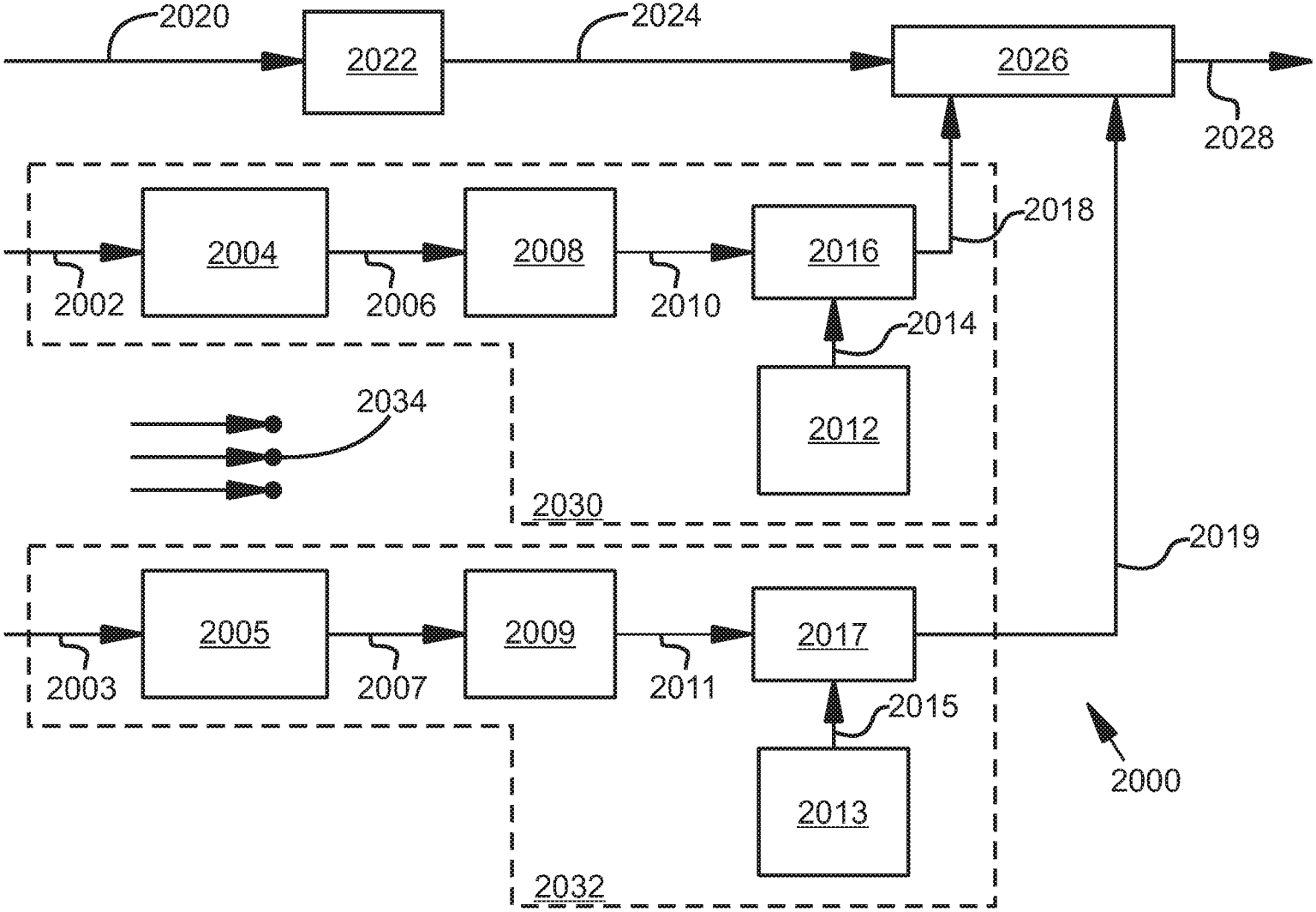
FIG. 20 illustrates a schematic diagram of an audio system.

FIG. 20 illustrates a schematic diagram of an audio system 2000 according to an embodiment. Audio system 2000 can comprise one or more modulated noise generators. A first modulated noise generator 2030 is shown comprising a filtered volume determiner 2004; a fixed volume adder 2008; a filtered noise generator 2012; and a signal modulator 2016. A second modulated noise generator 2032 is also shown. The second modulated noise generator 2032 is shown comprising a filtered volume determiner 2005; a fixed volume adder 2009; a filtered noise generator 2013; and a signal modulator 2017. Audio system 2000 may also include additional modulated noise signal generators 2034 each comprising a filtered volume determiner, a fixed volume adder, a filtered noise generator, and a signal modulator configured similarly to first modulated noise generator 2030 and to second modulated noise generator 2032. Audio system 2000 may also comprise a filtered volume reducer 2022 and a mixer 2026.

Filtered volume determiner 2004 can be configured to receive first signal 2002 corresponding to an audio signal. Filtered volume determiner 2004 can filter a signal and measure the time varying volume envelope of the filtered signal. According to an embodiment, filtered volume determiner 2004 is configured to generate second signal 2006 which corresponds to a volume envelope for a first range of selected frequencies of first signal 2002. According to an embodiment, the first range of selected frequencies can correspond to a range of frequencies where an individual has restricted sound perception or has hearing loss. Fixed volume adder 2008 can be coupled to filtered volume determiner 2004. Fixed volume adder 2008 can be configured to receive from filtered volume determiner 2004 the second signal 2006. Fixed volume adder 2008 can be configured to generate third signal 2010 corresponding to the sum of a second signal 2006 (or a weighted second signal 2006) and a fixed value. According to one embodiment, the fixed value is made approximately equal to an individual's threshold of hearing for a second range of selected frequencies. Filtered noise generator 2012 can be configured to generate a fourth signal 2014 corresponding to noise substantially within the second range of selected frequencies. Signal modulator 2016 can be coupled to fixed volume adder 2008 and to filtered noise generator 2012. Signal modulator 2016 can be configured to receive from fixed volume adder 2008 the third signal 2010, and signal modulator 2016 can be configured to receive from the filtered noise generator 2012 the fourth signal 2014. Signal modulator 2016 can be configured to generate fifth signal 2018 substantially similar to a product of third signal 2010 and fourth signal 2014 (or, for example, a weighted fourth signal 2014).

Filtered volume determiner 2005 can be configured to receive a ninth signal 2003. According to one embodiment, ninth signal 2003 can be substantially similar to first signal 2002. According to another embodiment, ninth signal 2003 is the same signal as first signal 2002. Filtered volume determiner 2005 can filter a signal and measure the time varying volume envelope of the filtered signal. According to an embodiment, filtered volume determiner 2005 can be configured to generate a tenth signal 2007 which corresponds to a volume envelope for a fourth range of selected frequencies of ninth signal 2003. According to an embodiment, the fourth range of selected frequencies can correspond to a range of frequencies where an individual has restricted sound perception or has hearing loss. Fixed volume adder 2009 can be coupled to filtered volume determiner 2005. Fixed volume adder 2009 can be configured to receive from filtered volume determiner 2005 the tenth signal 2007. According to an embodiment, fixed volume adder 2009 can be configured to generate an eleventh signal 2011 corresponding to the sum of tenth signal 2007 (or a weighted tenth signal 2007) and a fixed value made approximately equal to an individual's threshold of hearing for a fifth range of selected frequencies. According to other embodiments, a fixed value may be selected according to other methods. Filtered noise generator 2013 can be configured to generate a twelfth signal 2015 corresponding to noise substantially within the fifth range of selected frequencies. Signal modulator 2017 can be coupled to fixed volume adder 2009 and to filtered noise generator 2013. Signal modulator 2017 can be configured to receive from fixed volume adder 2009 the eleventh signal 2011, and signal modulator 2017 can be configured to receive from filtered noise generator 2013 the twelfth signal 2015. Signal modulator 2017 can be configured to generate a thirteenth signal 2019 substantially similar to a product of eleventh signal 2011 and twelfth signal 2015 (or a weighted twelfth signal 2015).

Filtered volume reducer 2022 can be configured to receive sixth signal 2020. According to one embodiment, sixth signal 2020 can be substantially similar to first signal 102. Filtered volume reducer 2022 can be configured to generate a seventh signal 2024 corresponding to sixth signal 2020 (or a weighted sixth signal 2020) wherein a portion of sixth signal 2020 substantially within a third range of selected frequencies is reduced or eliminated. Mixer 2026 can be coupled to signal modulator 2016, to signal modulator 2017, and to filtered volume reducer 2022. Mixer 2026 can be configured to receive from signal modulator 2016 the fifth signal 2018. Mixer 2026 can be configured to receive from signal modulator 2017 the thirteenth signal 2019. And mixer 2026 can be configured to receive from filtered volume reducer 2022 the seventh signal 2024. According to another embodiment, mixer 2026 may also additionally be coupled to one or more other similar signal modulators of one or more other modulated noise generators 2034. Mixer 2026 can be configured to generate a fourteenth signal 2028 substantially similar to the sum of fifth signal 2018, seventh signal 2024, thirteenth signal 2019 and any other such modulated signals as may be available from other modulated noise generators 2034 according to an embodiment.

According to an embodiment, audio system 2000 can be configured to superimpose upon, replace, or overwrite a portion of a signal within a range of frequencies where an individual has remaining hearing, with a noise signal weighted by the sum of a fixed value component and a time varying, amplitude modulated component; and by making the time varying, amplitude modulated component of the noise signal proportional to the time varying volume envelope of the signal within a range of frequencies where an individual has hearing loss; and by making the fixed component of the noise signal approximately equal to an individual's thresholds of hearing for the range of frequencies where the individual has remaining hearing.

Audio system 2000 can be utilized to improve the audibility, speech intelligibility, and word recognition characteristics of sound produced by an audio system or device that incorporates audio system 2000.

According to various embodiments, each filtered volume determiner of each modulated noise generator can measure the time varying volume envelope of the same, overlapping, or different ranges of frequencies of a sound signal. According to an embodiment, the ranges of frequencies used by the filtered volume determiners can correspond to ranges of frequencies where the individual has hearing loss.

According to various embodiments, each fixed volume adder of each modulated noise generator can add the same or different fixed values. According to an embodiment, the fixed values can be selected so as to be approximately equal to an individual's threshold of hearing for various ranges of frequencies where the individual has remaining hearing.

According to various embodiments, each filtered noise generator of each modulated noise generator can generate noise within the same, overlapping, or different ranges of frequencies. According to an embodiment, the ranges of frequencies used by the filtered noise generators can correspond to ranges of frequencies where the individual has remaining hearing.

According to various embodiments, each signal modulator of each modulated noise generator can generate a signal similar to the product a filtered noise generator signal and the sum of a fixed value and a time varying volume envelope signal. According to an embodiment, the time varying volume envelope signal may correspond to a weighted volume envelope signal.

According to an embodiment, audio system 2000 can have six modulated noise generators, each having a filtered volume determiner, fixed volume adder, filtered noise generator, and signal modulator. Within each of the modulated noise generators, portions of a signal can be replaced, overwritten, or superimposed with noise signals weighted by the sum of fixed value components and time varying, amplitude modulated components. According to one embodiment, the range of frequencies for each filtered volume determiner can encompass a ⅓-octave range (for example: 1260 to 1587 Hz; 1587 to 2000 Hz; 2000 to 2520 Hz; 2520 to 3175 Hz; 3175 to 4000 Hz; and, 4000 to 5040 Hz). The selected ranges of frequencies for each filtered noise generator can be the same ranges as the ranges used by the filtered volume determiners or can be shifted lower or higher, and/or wider or narrower as the case may be. According to an embodiment, the ranges used by each of the filtered noise generators can be a function of an individual's thresholds of hearing. For example, narrower ranges can be used when an individual's range of hearing is frequency limited. For example, if the individual's threshold of hearing is profound or has no response above a particular value such as 3000 Hz, the range of frequency for each of the six filtered noise generators can be segmented and adjusted to a smaller fraction of an octave than ⅓-octave. According to one embodiment for an individual whose hearing loss above 3000 Hz is profound or has no response, the ranges of frequencies for each of the six filtered noise generators can be set to ⅙-octaves: 1414 to 1587 Hz; 1587 to 1872 Hz; 1782 to 2000 Hz; 2000 to 2245 Hz; 2245 to 2520 Hz; and 2520 to 2828 Hz. According to an embodiment for an individual whose hearing loss above 2000 Hz is profound or has no response, the ranges of frequencies for each of the six filtered noise generators can be set to 1/12-octaves: 1414 to 1498 Hz; 1498 to 1587 Hz; 1587 to 1682 Hz; 1682 to 1782 Hz; 1782 to 1888 Hz; and 1888 to 2000 Hz. According to an embodiment, for each of the six fixed volume adders, the fixed volume added can be adjusted to correspond to an individual's threshold of hearing in each frequency range for each of the six filtered noise generators. According to various embodiments, each fixed value may be determined by independent measurements of an individual's threshold of hearing for each range of selected frequencies, estimated by interpolation, selected according to characteristic values in a population, or selected as being the most comfortable for an individual user. Other selection techniques for fixed values will also be apparent to one of ordinary skill in the art according to the disclosure. According to an embodiment, filtered volume reducer 2022 can be configured with a low pass filter (see for example FIGS. 18 and 19) corresponding to or overlapping with at least a portion of the ranges of frequencies selected for the filtered noise generators. According to an embodiment, filtered volume reducer can be configured to pass, for example, frequencies un-attenuated below 1250 Hz and reduce, attenuate, or eliminate frequencies above 1250 Hz and thus can be configured to generate seventh signal 2024. Mixer 2026 can be configured to add together seventh signal 2024 from filtered volume reducer 2022 and each of the six signals from each of the six signal modulators of each of the modulated noise generators, to generate fourteenth signal 2028.

According to various of the above described embodiments, sixth signal 2020 may correspond to first signal 2002, and may also have additional processing techniques applied to it, such as WDRC processing or AGC processing. WDRC and AGC processing can occur before the filtering performed by filtered volume reducer 2022, subsequent to the filtering performed by filtered volume reducer 2022, subsequent to mixer 2026, or not at all.

Figure 21:
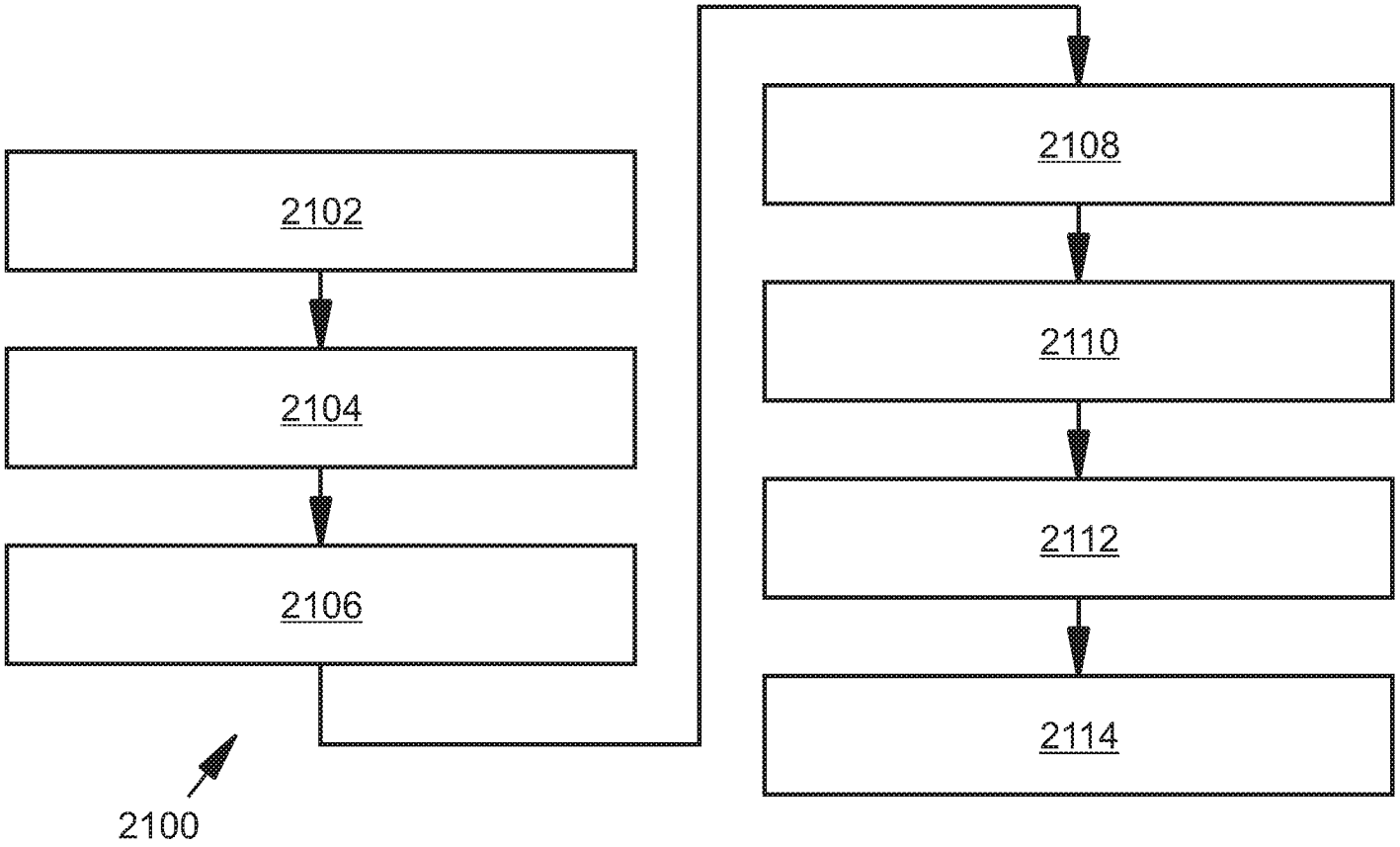
FIG. 21 illustrates a flow chart of a method for increasing the speech intelligibility of a signal.

FIG. 21 illustrates a flow chart of a method 2100 for increasing the speech intelligibility of a signal. In step 2102, an audio device, audio system, or audio subsystem can receive a first signal representing an audio signal. The first signal may be in analog or digital form. The first signal may also be split, duplicated, or processed such that first signal and any signal corresponding to the first signal may be used in multiple steps, such as step 2104 and step 2112. In step 2104, the audio system can select a volume envelope of a first range of frequencies from the first signal and output or generate a second signal representing the volume envelope of the first signal within a first range of frequencies. In step 2106, the audio system can add a fixed value to the second signal and output or generate a third signal representing the sum of the second signal and a fixed value. In step 2108, the audio system can output or generate a noise signal wherein the noise signal is substantially within a second range of frequencies. In step 2110, the audio system can modulate the noise signal with the third signal and output or generate a product signal representing the noise signal having been amplitude modulated by the third signal. In step 2112, the audio system can filter the first signal or filter a signal corresponding to the first signal and output or generate a fourth signal corresponding to a portion of the first signal, wherein the fourth signal corresponds to the first signal substantially within a third range of frequencies. In step 2114, the audio system can mix the product signal and the fourth signal and output or generate a summation signal representing the sum of the product signal and the fourth signal.

It is not intended that the steps of method 2100 be restricted to an exact order or that they be practiced or performed in a sequential manner over a period of time. For example, step 2104 can be performed before, after, or concurrently (in part or in whole) with step 2106. Furthermore, steps 2104 and 2106 can be performed by audio system before, after or concurrently with step 2108 which in turn can be performed by audio system before, after or concurrently with step 2112. According to one embodiment, various of steps 2104-2106, 2108, and 2112 can be performed concurrently or overlapping in time.

Figure 22:
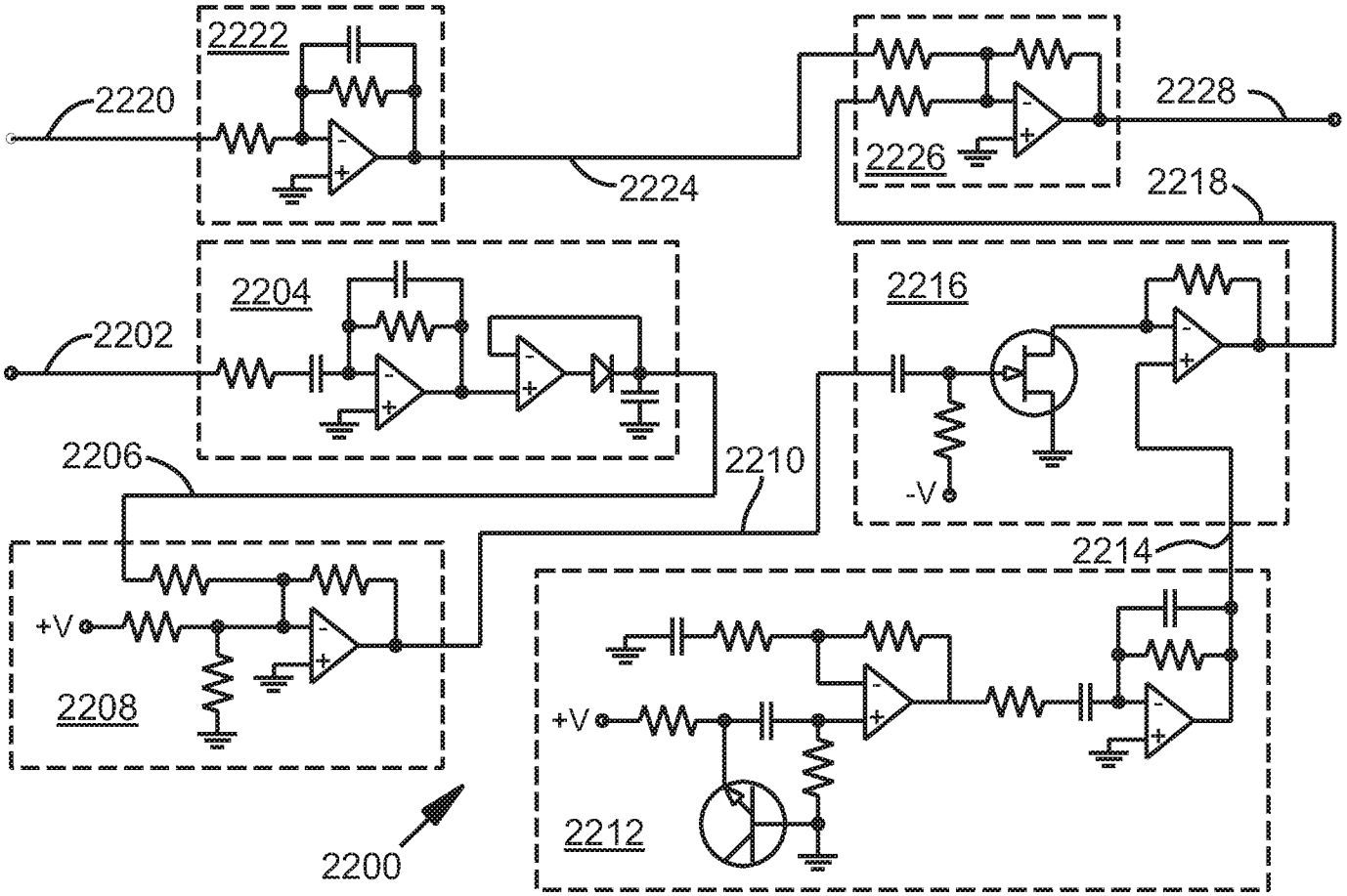
FIG. 22 illustrates a schematic diagram of an audio system.

FIG. 22 illustrates a schematic diagram of an audio system 2200. Audio system 2200 comprises one example of an analog implementation of audio system 100 (see FIG. 1) according to an embodiment. It is not intended that the implementation of audio system 2200 as an analog circuit be limiting in any way to the disclosure herein, but rather, audio system 2200 is provided to be instructive to the designer or manufacturer of any audio system, including, for example, the designer of a digital audio system. As noted previously, the audio systems, devices, components, blocks, elements, and methods, and signal processing systems, devices, components, blocks, elements, and methods, described herein can be implemented in a myriad of ways, including analog, digital, acoustical, etc. Furthermore, many embodiments may comprise combinations of analog, digital, or acoustical systems, devices, components, blocks, elements, and/or methods. For example, an acoustic signal may be received by a microphone and converted into an analog signal. Subsequently, the analog signal may be converted into a digital signal via an ADC. Various digital systems, devices, components, elements, blocks, and/or methods may be used to process the digital signal, which can then be subsequently converted back to an analog signal via a DAC. The analog signal can then be presented to a speaker which can convert the analog signal into an acoustic signal.

The electronic component symbols used in FIG. 22 represent resistors, capacitors, operational amplifiers, transistors, diodes, power sources, grounds, interconnects, and junctions. Those skilled in the art will also recognize the zener breakdown of transistor junction used as a noise generator for a filtered noise generator 2212, and a field effect transistor used as a voltage controlled resistor in a signal modulator 2216. Those skilled in the art will appreciate that there are multiplicities of analog and digital systems, devices, circuits, methods, programming methods, approaches, and strategies to implement the various components of audio system 2200. Audio system 2200 comprises a filtered volume determiner 2204, a fixed volume adder 2208, a filtered noise generator 2212, a signal modulator 2216, a filtered volume reducer 2222, and a mixer 2226.

According to an embodiment, elements represented by 2204, 2208, 2212, 2216, 2222, and 2226 and their functionality can correlate, respectively, to elements represented by 104, 108, 112, 116, 122, and 126 described previously in reference to FIG. 1. Furthermore, the signals represented by 2202, 2206, 2210, 2214, 2218, 2220, 2224, and 2228 and their functionality can correlate, respectively, to signals represented by 102, 106, 110, 114, 118, 120, 124, and 128 as described previously in reference to FIG. 1.

Figure 23:
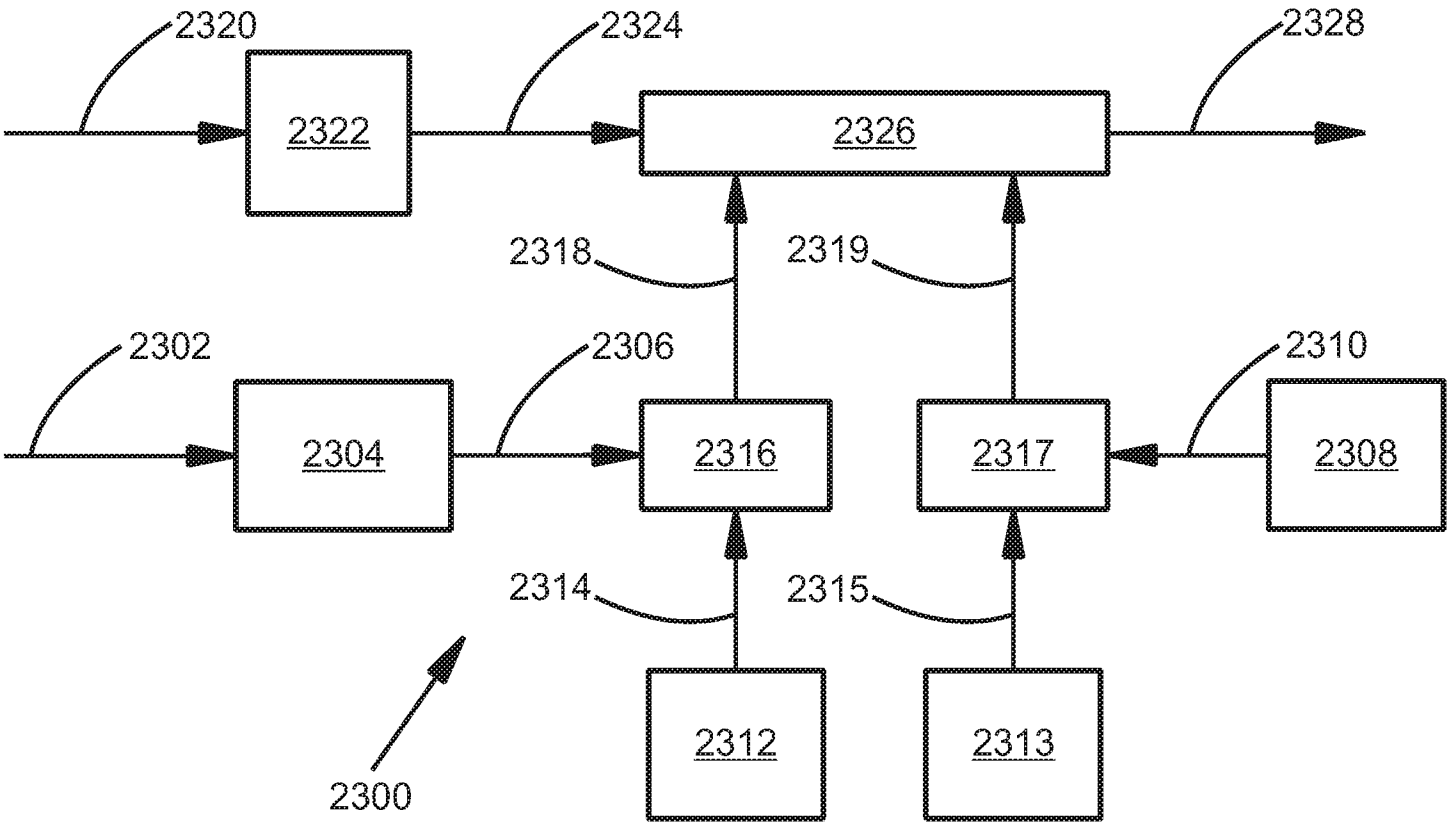
FIG. 23 illustrates a schematic diagram of an audio system.

FIG. 23 illustrates a schematic diagram of an audio system 2300. Audio system 2300 can be a stand-alone system or can be a subsystem of a larger system. Audio system 2300 can be configured to receive an input signal which may contain speech information, process the signal, and output a signal having improved speech intelligibility. Audio system 2300 can comprise a filtered volume determiner 2304, a fixed volume generator 2308, a first filtered noise generator 2312, a second filtered noise generator 2313, a first signal modulator 2316, a second signal modulator 2317, a filtered volume reducer 2322, and a mixer 2326.

According to an embodiment, audio system 2300 can be configured similar to audio system 100 described previously in reference to FIG. 1, however, audio system 2300 is configured generally to develop at least two noise signals independently, namely an amplitude modulated noise signal 2318 and a fixed volume noise signal 2319. Filtered volume determiner 2304 and its functionality can correlate to filtered volume determiner 104 described previously in reference to FIG. 1 and input signal 2302 can correlate to first signal 102 described previously in reference to FIG. 1. However, the output of filtered volume determiner 104, represented by volume envelope signal 2306 can be configured to be modulated with a first filtered noise signal 2314 independent from a fixed volume signal 2310. According to an embodiment, volume envelope signal 2306 can be a weighted volume envelope signal. Fixed volume generator 2308 and its functionality can correlate to fixed volume adder 108 described previously in reference to FIG. 1, however, fixed volume generator 2308 is not configured to receive volume envelope signal 2306 as an input signal. Fixed volume generator 2308 can be configured to generate fixed volume signal 2310 which can be configured to be modulated with a second filtered noise signal 2315 independent from volume envelope signal 2306. Filtered noise generator 2312 and second filtered noise generator 2313 and their functionality can correlate to filtered noise generator 112 as previously described in reference to FIG. 1. Filtered noise generator 2312 can be configured to generate a first filtered noise signal 2314, while second filtered noise generator 2313 can be configured to generate a second filtered noise signal 2315. First signal modulator 2316 and second signal modulator 2317 and their functionality can correlate to signal modulator 116 as previously described in reference to FIG. 1. First signal modulator 2316 can be configured to modulate volume envelope signal 2306 with first filtered noise signal 2314 generating amplitude modulated noise signal 2318. Second signal modulator 2317 can be configured to modulate fixed volume signal 2310 with second filtered noise signal 2315 generating fixed volume noise signal 2319. Filtered volume reducer 2322 and its functionality can correlate to filtered volume reducer 122 described previously in reference to FIG. 1 and input signal 2320 can correlate to sixth signal 120 described previously in reference to FIG. 1. Filtered volume reducer 2322 can be configured to receive input signal 2320 and generate a filtered signal 2324. Mixer 2326 and its functionality can correlate to mixer 126 described previously in reference to FIG. 1, however, Mixer 2326 can be configured to mix at least three signals, namely, a filtered signal 2324, amplitude modulated noise signal 2318, and fixed volume noise signal 2319, and generate a summation signal 2328 which can correlate to eighth signal 128 described previously in reference to FIG. 1.

Figure 24:
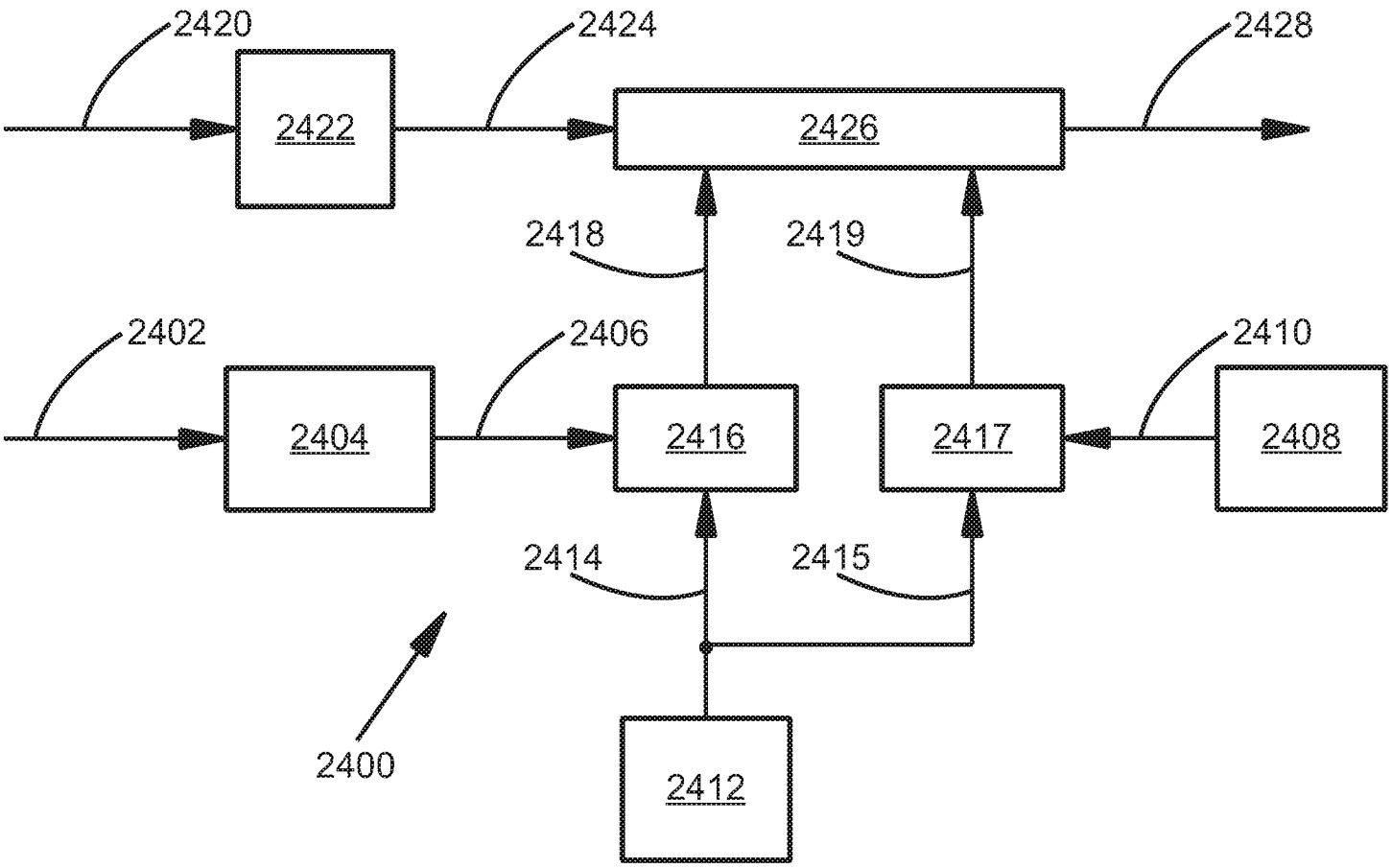
FIG. 24 illustrates a schematic diagram of an audio system.

FIG. 24 illustrates a schematic diagram of an audio system 2400. Audio system 2400 can be a stand-alone system or can be a subsystem of a larger system. Audio system 2400 is configured to receive an input signal which may contain speech information, process the signal, and output a signal having improved speech intelligibility. Audio system 2400 can comprise a filtered volume determiner 2404, a fixed volume generator 2408, a filtered noise generator 2412, a first signal modulator 2416, a second signal modulator 2417, a filtered volume reducer 2422, and a mixer 2426.

According to an embodiment, audio system 2400 can be configured similar to audio system 2300 described previously in reference to FIG. 23, however, audio system 2400 differs from audio system 2300 in that audio system 2400 has a single filtered noise generator 2412 which can generate a filtered noise signal that can be split into a first filtered noise signal 2414 and a second filtered noise signal 2415. The remainder of audio system 2400 can be configured in generally the same manner as audio system 2300 such that elements 2402, 2404, 2406, 2408, 2410, 2414-2420, 2422, 2424, 2426, and 2428 and their functionality can correlate generally with elements 2302, 2304, 2306, 2308, 2310, 2314-2320, 2322, 2324, 2326, and 2328 from FIG. 23.

Figure 25:
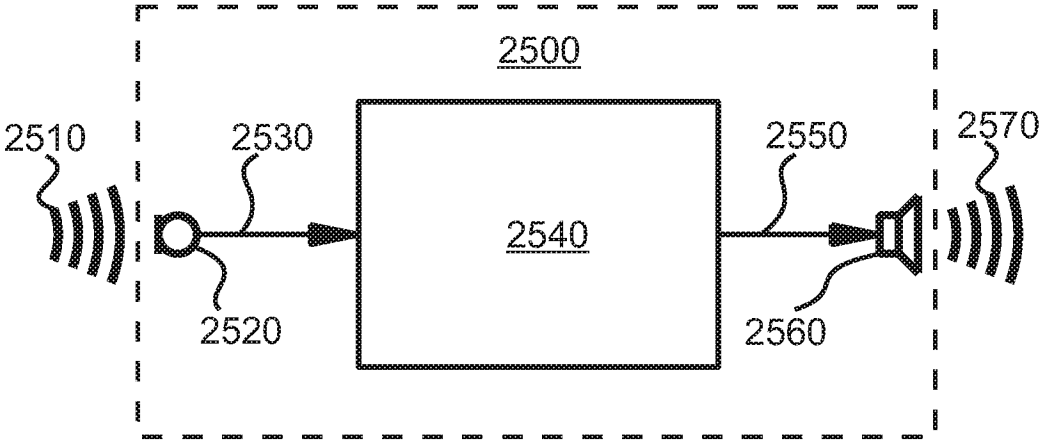
FIG. 25 illustrates a schematic diagram of an audio system.

FIG. 25 illustrates a schematic diagram of an audio system 2500. Audio system 2500 is generally configured to receive an input air conduction audio signal 2510 which may contain speech information, process the signal, and output an air conduction audio signal 2570 having improved speech intelligibility. Audio system 2500 can be a stand-alone system such as a hearing aid or can be a subsystem or integrated within a larger system such as a cell phone device or system. Audio system 2500 includes a synthetic frequency replacement processor 2540 which can be similar to audio system 100 (see FIG. 1), audio system 2000 (see FIG. 20), audio system 2200 (see FIG. 22), audio system 2300 (see FIG. 23), audio system 2400 (see FIG. 24), audio system 2700 (see FIG. 27) or any other embodiment or audio system enabled herein, including all embodiments or audio systems enabled, but not specifically enumerated herein. Audio system 2500 also includes a microphone 2520 and a speaker or receiver 2560. Microphone 2520 can provide a first signal 2530 to synthetic frequency replacement processor 2540. Synthetic frequency replacement processor 2540 can be configured to receive first signal 2530 and replace, supplant, overwrite, or superimpose upon, a portion of first signal 2530 within a band or range of frequencies where a user may have hearing ability, with a noise signal which is modulated by the volume envelope of a portion of first signal 2530 within a band or range of frequencies where a user may have hearing loss and then output a resulting output signal 2550 to speaker 2560. Furthermore, according to an embodiment, the noise signal can be boosted, lifted, weighted, or translated, if necessary, to exceed a user's threshold of hearing within a band or range of frequencies where a user may have hearing ability. Speaker 2560 can be configured to receive output signal 2550 and convert it to air conduction audio signal 2570 having improved speech intelligibility.

Figure 26:
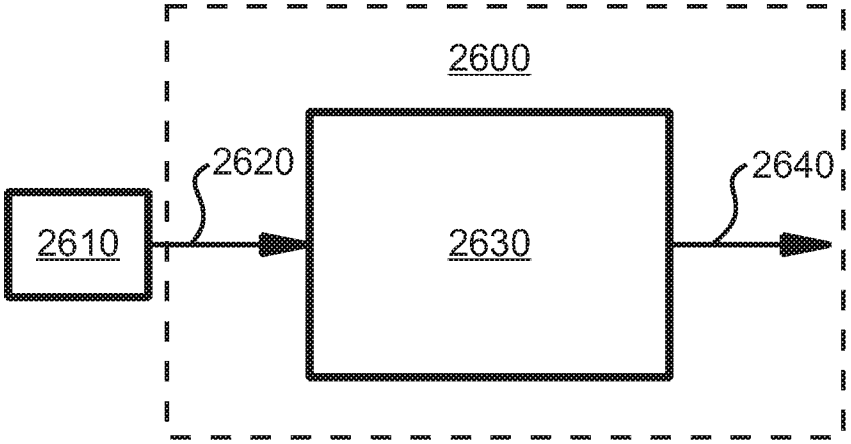
FIG. 26 illustrates a schematic diagram of an audio system.

FIG. 26 illustrates a schematic diagram of an audio system 2600. Audio system 2600 is generally configured to receive an input signal 2620, which may contain speech information, from a signal source 2610, process the signal, and output an output signal 2640 having improved speech intelligibility. Audio system 2600 can be a stand-alone system such as with a television or can be a subsystem of a larger system such as with media delivered via the internet. According to various embodiments, signal source 2610 can transmit input signal 2620 wirelessly, via a wired connection, or via a combination of wired and wireless communications systems. Audio system 2600 includes a synthetic frequency replacement processor 2630 which can be similar to audio system 100 (see FIG. 1), audio system 2000 (see FIG. 20), audio system 2200 (see FIG. 22), audio system 2300 (see FIG. 23), audio system 2400 (see FIG. 24), audio system 2700 (see FIG. 27) or any other embodiment or audio system enabled herein, including all embodiments or audio systems enabled, but not specifically enumerated herein. Synthetic frequency replacement processor 2630 can be configured to receive input signal 2620 and replace, supplant, overwrite, or superimpose upon, a portion of input signal 2620 within a band or range of frequencies where a user may have hearing ability, with a noise signal which is modulated by the volume envelope of a portion of input signal 2620 within a band or range of frequencies where a user may have hearing loss and then output the resulting output signal 2640 having improved speech intelligibility. According to an embodiment, the noise signal can be boosted, lifted, weighted, or translated, if necessary, to exceed a user's threshold of hearing within a band or range of frequencies where a user may have hearing ability.

Figure 27:
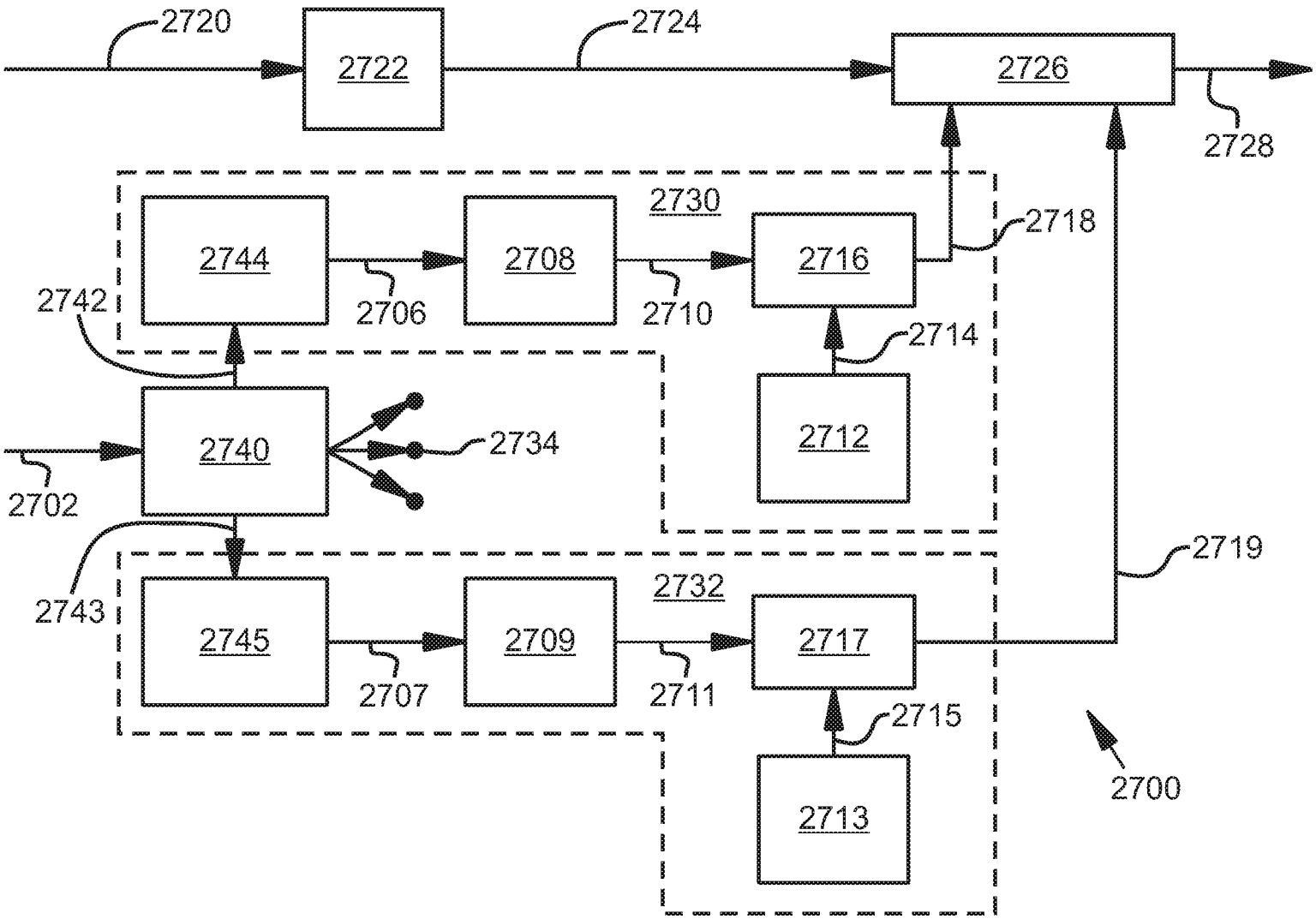
FIG. 27 illustrates a schematic diagram of an audio system.

FIG. 27 illustrates a schematic diagram of an audio system 2700 according to an embodiment. Audio system 2700 can comprise one or more modulated noise generators. A first modulated noise generator 2730 is shown comprising a first filtered volume determiner or first volume determiner 2744; a fixed volume adder 2708; a filtered noise generator 2712; and a signal modulator 2716. A second modulated noise generator 2732 is also shown. Second modulated noise generator 2732 is shown comprising a second filtered volume determiner or second volume determiner 2745; a fixed volume adder 2709; a filtered noise generator 2713; and a signal modulator 2717. Audio system 2700 may also include additional modulated noise signal generators 2734 each comprising a filtered volume determiner or volume determiner, a fixed volume adder, a filtered noise generator, and a signal modulator, configured similarly to first modulated noise generator 2730 and to second modulated noise generator 2732. Audio system 2700 may also comprise a filtered volume reducer 2722, a mixer 2726, and a filter bank 2740. According to an embodiment, filter bank 2740 can be configured to receive a first signal 2702 and split, separate, or filter first signal into a first frequency sub-band signal 2742 and a second frequency sub-band signal 2743. According to an embodiment, filter bank 2740 can also be configured to split, separate, or filter first signal 2702 into one or more additional frequency sub-band signals, each of which can be output to the one or more additional modulated noise signal generators 2734. According to one embodiment, filter bank 2740 can comprise an array of band pass filters configured to split, separate, or filter first signal 2702 into one or more frequency sub-band signals. Those skilled in the art will recognize additional methods and components to implement filter bank 2740, including digital or analog methods and components.

According to an embodiment, audio system 2700 can be configured similar to audio system 2000 described previously in reference to FIG. 20, however, audio system 2700 differs from audio system 2000 in that audio system 2700 implements a filter bank 2740 to split, separate, or filter first signal 2702 into one or more frequency sub-band signals, for example, first frequency sub-band signal 2742, second frequency sub-band signal 2743, and if applicable, additional frequency sub-band signal signals. According to one embodiment, given that first frequency sub-band signal 2742, second frequency sub-band signal 2743, and if applicable, additional frequency sub-band signals are already filtered signals, first volume determiner 2744 and second volume determiner 2745 may not include a filter or perform a filtering function. According to another embodiment, first volume determiner 2744 and second volume determiner 2745, and additional volume determiners if applicable, may include a filter or perform a filtering function in order to further process first frequency sub-band signal 2742 and second frequency sub-band signal 2743 respectively. According to various embodiments, various of the frequency sub-bands may be adjacent to one another, overlap one another, and/or be separated from one another.

According to an embodiment, the remainder of audio system 2700 can be configured in generally the same manner as audio system 2000 such that elements 2702, 2706-2720, 2722, 2724, 2726, and 2728 and their functionality can correlate generally with elements 2002, 2006-2020, 2022, 2024, 2026, and 2028 from FIG. 20.

Figure 28:
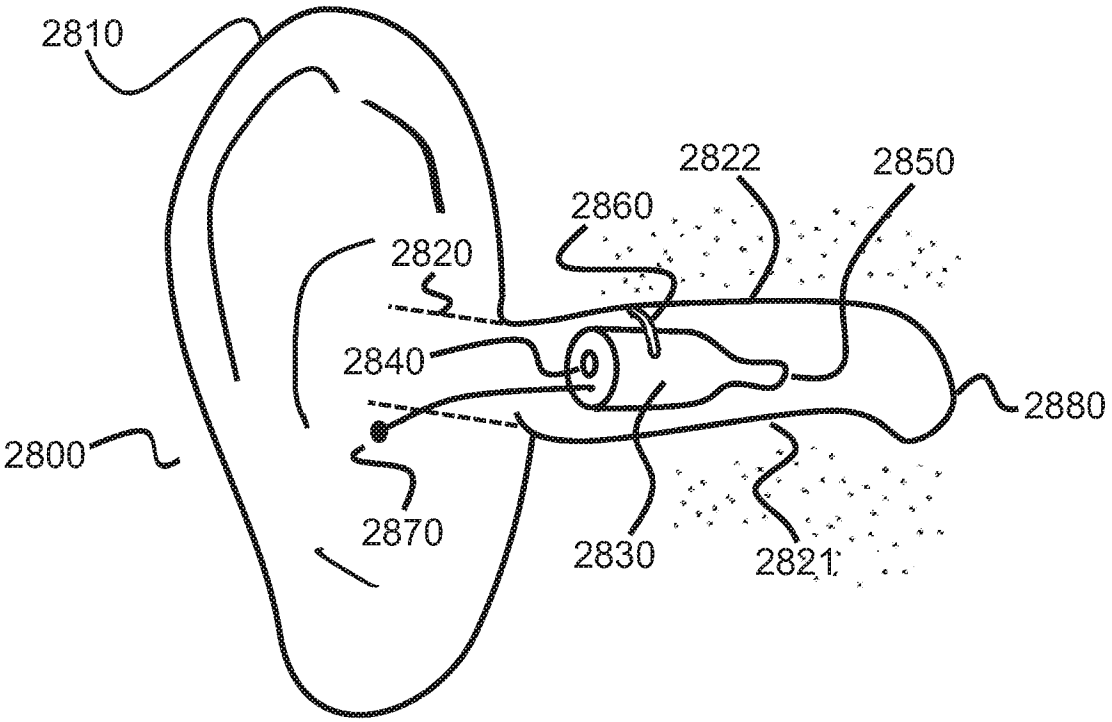
FIG. 28 illustrates a schematic diagram of an audio system.

FIG. 28 illustrates a hearing aid 2830 within an ear 2800. Hearing aid 2830 may be any type of hearing aid including an in-the-ear (ITE) hearing aid, an in-the-canal (ITC) hearing aid, a completely-in-canal (CIC) hearing aid, an invisible-in-canal (IIC) hearing aid, a receiver-in-canal hearing aid (RIC), a behind-the-ear hearing aid (BTE), or any other type of hearing aid known to those skilled in the art. Ear 2800 includes a pinna 2810 and an ear canal 2820. According to an embodiment, hearing aid 2830 or a portion of hearing aid 2830 can be inserted in ear canal 2820. According to an embodiment, all of hearing aid 2830 or a portion of hearing aid 2830 can be smaller than ear canal 2820. According to an embodiment, a portion of hearing aid 2830 can make contact to at least one point along the ear surface 2821 and/or 2822 of ear canal 2820. According to an embodiment, hearing aid 2830 can have a microphone 2840. According to an embodiment, hearing aid 2830 can have a speaker or receiver 2850. According to an embodiment, the output of receiver 2850 can be directed towards the tympanic membrane 2880. According to an embodiment, a retaining or support device 2860 can be used to keep hearing aid 2830 or a portion of hearing aid 2830 from falling out of ear canal 2820. According to an embodiment, a removal stem 2870 may be used to extract hearing aid 2830 or a portion of hearing aid 2830 from the ear canal 2820. In the presence of sound, air conduction sound can be focused by pinna 2810 into the ear canal 2820. According to an embodiment, sound can follow the ear canal 2820 to the tympanic membrane 2880 as, according to an embodiment, hearing aid 2830 may be non-occluding and can allow sound to pass around hearing aid 2830. According to an embodiment, hearing aid 2830 may not include all of the elements or features described in the above description of hearing aid 2830. Furthermore, according to an embodiment, hearing aid 2830 may comprise additional elements not described above but typical of one or more types of hearing aid. According to an embodiment, hearing aid 2830 may comprise other types of hearing aids (not shown).

According to various embodiments, hearing aid 2830 may comprise any embodiment of an audio system described herein, including, audio system 100 (see FIG. 1), audio system 2000 (see FIG. 20), audio system 2200 (see FIG. 22), audio system 2300 (see FIG. 23), audio system 2400 (see FIG. 24), audio system 2700 (see FIG. 27) or any other embodiment or audio system enabled herein, including all embodiments or audio systems enabled, but not specifically enumerated herein. According to an embodiment, the modulated noise output from receiver 2850 can be added to the sound described above traveling to the tympanic membrane 2880.

According to an embodiment, the modulated noise output of receiver 2850 and the configuration of hearing aid 2830 can reduce or eliminate feedback problems, aesthetics concerns, earwax accumulation issues, maintenance problems, skin irritation, occlusion effect, and other problems typically associated with hearing aids.

In reference to all of the foregoing disclosure, the above described embodiments enable solutions, improvements, and benefits to many problems and issues affecting conventional audio systems and conventional audio devices and offer improved functionality for audio systems and audio devices, for example:

First, the use of WDRC can be reduced or even eliminated, including where speech information content is critical. WDRC causes amplitude information in the audio signal to be smeared by backwards-looking attack and release time constants. According to various embodiments, no time constants are required to lift the audio above an individual's threshold of hearing and thus there is no smearing as a result. WDRC can push background noise into a speech signal especially during breaks between words. According to various embodiments, there may be no perceived loss in the signal-to-noise ratio by the user or even a perceived improvement in the signal-to-noise ratio by the user;

Second, phones can be both frequency shifted to a more audible portion of a user's hearing spectrum and boosted, lifted, weighted, or translated, to make amplitude modulated information audible to a user;

Third, the hearing level of even the faint unvoiced phones can be "lifted" to exceed an individual's threshold of hearing for the band;

Fourth, the articulation in speech can be preserved, including for example, the voiced modulation of un-voiced phones;

Fifth, WDRC artifacts may not be introduced where sounds are replaced with audible noise having been weighted by a sum of a fixed component and a time varying, amplitude modulated component;

Sixth, hearing aid feedback or "squealing" can be reduced or eliminated. Feedback or squealing can occur when the loop gain exceeds unity between the microphone and receiver. Given the speed of sound and the physical distance between the microphone and receiver, feedback or "squealing" is reduced or eliminated entirely where noise is used. According to various of the above described embodiments, frequency shifted and/or amplitude modulated noise can be used at frequencies which are prone to feedback in audio systems and devices. Because phase relationships in noise are random, constructive interference can be greatly reduced or eliminated. Furthermore, any possible feedback to the microphone from an added noise replacing sound signal will be known a priori. According to various of the above described embodiments, such feedback can be cancelled by re-adding the same noise replacing sound signal with delay, attenuation, and/or phase inversion. Thus, according to the above described embodiments, feedback or squealing can be completely eliminated;

Seventh, by eliminating feedback or squealing, occluding ear molds can also be eliminated. Generally, one of the main purposes of ear molds is to attenuate feedback when using amplification. Without the need to fight feedback, occlusion can be removed. Eliminating occluding ear molds from hearing aids can have many major benefits. For example, occluding ear molds can cause physical irritation to one's ears. Occluding ear molds can cause the "occlusion effect" which can be uncomfortable for many hearing aid users. Occluding ear molds can accelerate the accumulation of cerumen or earwax. Occluding ear molds can cause an uncomfortable sensation of ear drum pressure while chewing. Furthermore, when using occluding ear molds, sound leakage has often caused hearing healthcare providers to reduce prescribed amplification in high frequency bands in order to prevent feedback associated with amplification. According to the above embodiments, these problems can be eliminated and the hearing health care provider can optimize the gain prescription for maximum speech intelligibility;

Eighth, placing hearing aid electronics behind-the-ear (BTE) and away from the harsh/moist environment of the ear canal can be one way to reduce long term hearing aid maintenance issues. Using a BTE sound tube however introduces, among other issues, sound tube resonance issues. The sound tube can become like a "trumpet" at certain frequencies. Sound tube resonances require compensation with hearing aid programming as the length of each sound tube can vary according to the individual. One workaround is the receiver-in-canal (RIC) where most of the electronics can remain BTE while the receiver (i.e. speaker) is placed in the ear canal. The RIC solution can be expensive however, and RIC receivers are still subjected to the harsh, moist environment in the ear canal and can fail much earlier than the remaining portion of the hearing aid behind the ear. According to the above described embodiments, high frequency noise can be used to convey speech information where a sound tube might become resonant. According to the above described embodiments, amplitude modulated noise can be random and constructive interference from standing waves in a sound tube can be reduced or eliminated. Furthermore, additional programming is not required to compensate for sound tube length and efficiency of the audio system or audio device is increased. According to the above described embodiments a receiver can be placed BTE with reduced complexity, reduced cost, and improved efficacy;

Ninth, frequency shifted and/or amplitude modulated noise can have advantages for in-the-ear (ITE), completely-in-the-canal (CIC) or similar hearing aids. Most individuals needing a hearing aid have reasonable hearing for voiced phone frequencies. Sensorineural hearing loss is typically more acute at high frequencies. For aesthetic reasons, many consumers desire ITE, CIC or similar hearing aids. According to the above described embodiments, an open-fit (non-occluding) ITE, CIC or similar hearing aid can be created. Amplitude modulated noise can be random and constructive interference can be reduced and/or eliminated. With an open-fit ITE, CIC or similar design, the individual can hear low frequency voiced phones as the open-fit ITE, CIC or similar design can allow these frequencies to leak around the hearing aid. An open-fit CIC according to various embodiments can also implement the filtered volume reducer elements in a mechanical way inherent to these embodiments since high frequency sounds are very directional and have a much harder time going around a partially occluding ITE, CIC or similar hearing aid. Furthermore, an open-fit ITE, CIC or similar hearing aid according to various embodiments can also implement the mixer elements in a mechanical way inherent to these embodiments since mixing can occur as air conduction mixing at a location past the ITE, CIC or similar as the leaking low frequency sound mixes with the amplitude modulated noise produced by the ITE, CIC or similar hearing aid according to various embodiments. The above described embodiments and improvements enable an open-fit (i.e. not fully occluding) ITE, CIC or similar hearing aid effective for those with severe hearing loss;

Tenth, the need for telecoils in hearing aids can be eliminated. Telecoils are used for hearing aids to work with telephones or cell phones. A hearing aid will squeal with feedback if a hearing aid user puts a telephone next to their hearing aid without a telecoil. Hearing aids with telecoils generally switch from a microphone input to the telecoil input. Telecoils generally use magnetic coupling to the telephone or cell phone for sound input. According to the above described embodiments, a hearing aid is enabled which can eliminate feedback or squealing. According to the above described embodiments, a hearing aid microphone can be used with a telephone or cell phone held against the hearing aid. According to the above described embodiments telecoil technology can be eliminated from hearing aids and the complexity and expense of the hearing aid can be reduced;

Eleventh, tinnitus can be reduced or eliminated. Tinnitus, or ringing in the ears, is a natural response of the cochlea to the loss of outer hair cells. For persons who experience tinnitus, some of their remaining outer hair cells in their cochlea can be recruited to provide minimum rate encoding to the inner hair cells which causes tinnitus. According to the above described embodiments, an audio system or device, such as a hearing aid, can introduce noise at or just below the threshold of hearing across the entire frequency spectrum for the individual which can reduce or eliminate tinnitus in the individual;

Twelfth, problems associated with notches in hearing can be overcome. Notches are common for individuals with severe hearing loss. Notches are frequencies where individuals have little or no sensation of sound. Conventional testing of hearing thresholds at every frequency for a patient would be very tedious and thus notches are often missed by the audiologist or person fitting a hearing aid. According to various of the above described embodiments, amplitude modulated noise comprising speech information can be shifted to another band or distributed through each band. If notches are present, the shifted or distributed amplitude modulated noise can still be heard where there are no notches;

Thirteenth, sounds uncharacteristic of unvoiced phones can be filtered effectively and efficiently. For example, according to an embodiment, sounds from 1400 Hz to 4500 Hz can be filtered to exclude sounds uncharacteristic of unvoiced phones;

Benefits, other advantages, and solutions to problems and issues have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

In view of all of the above, it is evident that novel audio systems, audio devices, and methods are disclosed. Included, among other embodiments, is an audio system which can process an audio signal and improve the speech intelligibility of the audio signal. Improved speech intelligibility can be obtained, according to an embodiment, by replacing, supplanting, overwriting, or superimposing upon, a portion of the audio signal within a band or range of frequencies where a user may have hearing ability, with a noise signal which is modulated by the volume envelope of a portion of the audio signal within a band or range of frequencies where a user may have hearing loss, and which may be boosted, lifted, weighted, or translated, if necessary, to exceed a user's threshold of hearing within a band or range of frequencies where a user may have hearing ability. According to various embodiments, bands or ranges of frequencies may be wide or narrow and one or more instances of any of the above described embodiments may be integrated into a single audio system, wherein each instance can be configured to process a same, different or overlapping band or range, or set of bands or set of ranges within the audio signal. Thus, an audio signal processed according to the various above described embodiments may contain a noise signal in audible ranges where the noise signal (or sum of a plurality of noise signals) is amplitude modulated with speech information obtained from less audible ranges, and where the noise signal (or sum of a plurality of noise signals) may have a power spectrum which relates, corresponds, or is a function of a user's hearing threshold across a portion of the audible ranges.

While the subject matter of the invention is described with specific and example embodiments, the foregoing drawings and descriptions thereof depict only typical embodiments of the subject matter, and are not therefore to be considered limiting of its scope. It is evident that many alternatives and variations will be apparent to those skilled in the art and that those alternatives and variations are intended to be included within the scope of the present invention. For example, some embodiments described herein include some elements or features but not other elements or features included in other embodiments, thus, combinations of features or elements of different embodiments are meant to be within the scope of the invention and are meant to form different embodiments as would be understood by those skilled in the art. Furthermore, any of the above-described elements, components, blocks, systems, structures, devices, filters, noise generation methods, ranges and selection of ranges, applications, programming, signal processing, signal analysis, signal filtering, implementations, proportions, flows, or arrangements, used in the practice of the present invention, including those not specifically recited, may be varied or otherwise particularly adapted to specific environments, users, groups of users, populations, manufacturing specifications, design parameters, or other operating requirements without departing from the scope of the present invention. Additionally, the steps recited in any method or processing scheme described above or in the claims may be executed in any order and are not limited to the specific order presented in the above description or in the claims. Finally, the components and/or elements recited in any apparatus claims may be assembled or otherwise operationally configured in a variety of permutations and are accordingly not limited to the specific configuration recited in the claims.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of the invention.

What is claimed is:

1. An audio system comprising:

a signal processor configured to receive an input signal and generate a modified input signal by replacing a first portion of the input signal within a first range of frequencies with a modulated noise signal, wherein the modulated noise signal comprises a parametrically formulated noise signal modulated with a signal corresponding to the sum of a fixed value and a volume envelope of a second portion of the input signal and wherein the fixed value corresponds to an amount of hearing loss of a user, and wherein the parametrically formulated noise signal comprises a plurality of time-ordered periodic waves within the first range of frequencies.

2. The audio system of claim 1, wherein replacing the first portion of the input signal comprises attenuating the first range of frequencies within the input signal and mixing the input signal having an attenuated first range of frequencies with the modulated noise signal.

3. The audio system of claim 2, wherein the volume envelope of the second portion of the input signal comprises the volume envelope of the input signal within a second range of frequencies.

4. The audio system of claim 3, wherein a portion of the second range of frequencies is higher than the first range of frequencies.

5. The audio system of claim 1, wherein the audio system comprises a hearing aid.

6. The audio system of claim 1, wherein replacing the first portion of the input signal comprises filtering out the first range of frequencies from the input signal and mixing the filtered input signal with the modulated noise signal.

7. The audio system of claim 6, wherein the volume envelope of the second portion of the input signal comprises the volume envelope of the input signal within a second ranged of frequencies.

8. The audio system of claim 7, wherein a portion of the second range of frequencies is higher than the first range of frequencies.

* * * * *